US005903140A

United States Patent [19]

Acatrinei

[11] Patent Number: 5,903,140

[45] **Date of Patent: *May 11, 1999**

[54] LOW DISSIPATION CONTROLLABLE ELECTRON VALVE

[75] Inventor: Beniamin Acatrinei, San Diego, Calif.

[73] Assignee: Bensys, Inc., San Jose, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,171

[22] Filed: Sep. 26, 1996

Related U.S. Application Data

[63] Continuation of application No. 08/507,784, Jul. 26, 1995, Pat. No. 5,598,093.

[51] Int. Cl.[6] ..... G05F 5/00

[52] U.S. Cl. ..... 323/299

[58] Field of Search ..... 323/220, 223, 323/235, 282, 284, 285, 299

[56] References Cited

U.S. PATENT DOCUMENTS

| | | | |
|---|---|---|---|
| 5,319,393 | 6/1994 | Yamada | 323/313 |
| 5,412,309 | 5/1995 | Ueunten | 323/316 |
| 5,424,932 | 6/1995 | Inou et al. | 363/21 |
| 5,479,090 | 12/1995 | Schultz | 323/284 |

*Primary Examiner*—Matthew Nguyen
*Attorney, Agent, or Firm*—Fish & Richardson P.C.

[57] ABSTRACT

A controllable electron valve for controlling an energy delivered to a load circuit in response to an input power source, comprising a power controller for controlling a voltage across said load circuit, an input current being introduced to said power controller via an input voltage ($V_{IN}$) electrode, said input current being generated by said input power source, said input current including a load current and an internal current ($I_{IN}$), said load current being output by said power controller to said load circuit, $I_{IN}$ being output via a switching output; a current controller for maintaining $I_{IN}$ at a constant value, said current controller having an output coupled to a ground, having an input, and having at least one current control electrode; a voltage threshold controller for outputting a threshold current, said voltage threshold controller having at least one input and at least one output; and a current separator for controlling the passage of $I_{IN}$ and said threshold current to said constant current source, a first input of said current separator being coupled to said switching output of said power controller, a second input of said current separator being coupled to said output of said voltage threshold controller, an output of said current separator being coupled to said input of said current controller.

15 Claims, 16 Drawing Sheets

THE BLOCK SCHEMATIC DIAGRAM FOR THE CLASSIC BENISTOR

THYRISTOR'S AC CIRCUIT

THYRISTOR'S INTERNAL SCHEMATIC DIAGRAM (AVALANCHE)

SERIES WINDOW COMPARATORS

PARALLEL WINDOW COMPARATORS

CLASSIC BENISTOR

PARALLEL EMBODIMENT

SERIES EMBODIMENT

OFF/ON P.BENISTOR

ON/OFF N. BENISTOR

LINEAR BENISTOR

THE BLOCK SCHEMATIC DIAGRAM FOR THE CLASSIC BENISTOR

THE PARALLEL METHOD EMBODIMENT

THE SERIES METHOD EMBODIMENT

THREE-TERMINAL OFF/ON BENISTOR

THREE-TERMINAL ON/OFF BENISTOR

THREE-TERMINAL (INVERTING) LINEAR BENISTOR

THYRISTOR'S VOLTAGE CONTROL GRAPHICS

THE PARALLEL W. COMPARATOR OUTPUT-VOLTAGE VERSUS $V_{IN}$

THE SERIES W. COMPARATOR OUTPUT VOLTAGE VERSUS $V_{IN}$

FIG. 6 THE OUTPUT VOLTAGE WAVEFORM OF A CLASSIC BEHISTOR

LOW DISSIPATION CONTROLLABLE ELECTRON VALVE

This is a continuation of application Ser. No. 08/507,784, filed Jul. 26, 1995, now U.S. Pat. No. 5,598,093.

BACKGROUND OF THE INVENTION

1. Field of the Invention

The present invention relates to a controllable electron valve. More particularly, the present invention relates to a multi-electrode electron valve that is able to control, separately or simultaneously, the amount of current, the maximum voltage and/or the effective value of a pulse wave voltage incoming from a power source and outputting to a load. This controllable electron valve combines the large number and impedance of the vacuum tube's command electrodes, the transistor's flexibility, and the thyristor's (SCR's) self-switching mode of operation.

2. Description of Related Art

Conventionally, there exist three controllable electron valves. First, there are vacuum tubes—triodes, tetrodes, pentodes, hexodes, etc. The difference between these vacuum tubes is the number of their command electrodes (grids). Each of the grids (control, screen, suppressor, etc.) allow a vacuum tube to provide increased accuracy for control of the output current. The large impedance of these grids provides a means to control the output current using variations of the input voltage. (The input current is negligible.) This simplifies the vacuum tube's design circuits and allows for exchangeability between the majority of worldwide manufacturers. However, vacuum tubes, with the exception of kinescope tubes, are essentially obsolete, as they are physically large, hot, and fragile and need a high anodic voltage and a separate filament current circuit.

The second type of controllable electron valves are transistors, which have eliminated the disadvantages associated with vacuum tubes. Hybrids such as the Bipolar-MOS-FET are able to work in the linear mode with a large variety of voltages and currents primarily in the low to medium power range. The transistor's use with high power ranges in the linear mode is restricted as its internal dissipation increases. This can be partly overcome by using the transistor in a switching mode, but then sophisticated external circuits are needed to decrease the transistor's transit time and to decrease the noise introduced into the circuit.

Third, there are thyristors (SCRs) which by way of their self-switching operational mode are able to address the dissipation disadvantage of a transistor used with high power. The thyristor's self-switching property is based upon a two transistor positive feedback. See FIG. 1A. When the gate switch is on, a small current $I_1$ (limited by the resistor) will cross the base emitter junction of the NPN transistor (T2). This current will generate a collector current for the NPN transistor (T2) $I_2$=BI1. The second current will generate in the collector circuit of the PNP transistor (T1) a third current, $I_3=BI_2$. In this situation the NPN transistor's base current, $I_1$, becomes larger, $I_1=I_3=B2I_1$. This cycle is repeated infinitely, creating an avalanche, and keeps the entire component in saturation, minimizing the voltage between the thyristor anode and cathode, thereby delivering to the load almost the entire power from the source. The larger internal current, $I_3$, replaces the small initial current, $I_1$, and the thyristor maintains itself in the "on" position (self-switching), even if the gate's switch is off. The load's resistance will limit, externally, the current according to Ohm's low. A disadvantage of the thyristor-based system is that it requires sophisticated external circuits such as a second SCR or a large power switching transistor, to stop the avalanche when used in a DC power circuit.

The thyristor, at this time, is the ideal controller in high power AC circuits, because the power wave itself decreases to zero. The periodic decrease of the power wave acts as a reset for the thyristor. Each time the power wave reaches zero voltage the avalanche is automatically stopped, and the thyristor will need a new pulse at the gate to begin a new conduction time. However, even in AC circuits, the thyristor requires a sophisticated external circuit to control the power to a load.

A classic thyristor's AC circuit, (see prior art FIG. 1B), utilizes a "zero cross detector" to synchronize a "phase controller" with the positive rectified pulses arising from a rectifier bridge. The "phase controller" acts as a timer from zero to the maximum time of one pulse period. After a predetermined time the "phase controller" will create a means for a UJT driver to provide a short pulse to the thyristor's gate, via a separator transformer. Starting from the gate's pulse moment until the anodic pulse will decay to zero, the thyristor will be an "on" switch, and the load will receive the remainder of the power AC pulse. (See FIG. 5A.)

A disadvantage of the use of an SCR as a power controller is that the stability of the output's effective voltage is affected by the input wave's variations in frequency and/or amplitude. Still another disadvantage of using the thyristor in either AC or DC circuits is the introduction of noise that occurs because there is no internal limitation of the component's current (avalanche). Yet another disadvantage of this component is the way the SCR controls the effective value of a power wave by decreasing the maximum voltage. Loads such as florescent bulbs and some motors do not work efficiently with lower than a nominal voltage.

Therefore, a need exists for a new controllable electron valve that is multi-electrode; has large input impedance; works in a linear, a switching, or a self-switching mode of operation; can integrate the linear and self-switching modes of operation for each power pulse period; introduces relatively low noise; has low internal dissipation; does not rely on sophisticated external circuits for the switching mode; provides for internal limitation of current; and does not necessarily decrease the maximum voltage of the power wave in order to decrease its effective value.

SUMMARY OF THE INVENTION

Accordingly, the present invention is directed to a controllable electron valve, including method, component and apparatus, that substantially obviates one or more of the problems due to limitations and disadvantages of the related art.

Several embodiments are described herein to present a complete view of the electron valve's possibilities of control, as a component or as an apparatus, into a circuit. The internal structure of the electron valve consists in four principal functional blocks: a "power controller", a "current separator", a "current controller", and a "voltage threshold controller." Externally, the electron valve may have (at least) three electrodes, or as many as are required for each particular application. The "classic" electron valve, as the subject of this invention, comprises eight distinct electrodes and it is generic for all the others, which having less or more than eight electrodes, represent only particular embodiments, based on the same principle and the same block schematic diagram. The basic electrodes are: "$V_{IN}$", "$V_{OUT}$", "CE", "cc", "cc", "SS", "OFF/ON" and "ON/

OFF". These eight electrodes may exist internally and/or externally and may be used separate and/or simultaneously, but each of them provides the electron valve more flexibility in controlling the output current and voltage.

It is an object of the present invention to provide a method, a component, and an apparatus, regarding a multi-electrode electron valve, that can control, separately or simultaneously, the amount of current, the maximum voltage, and/or the effective voltage value inputted from a power source and outputted to a load, in a linear mode, in a switching mode and/or in a self-switching mode of operation.

It is also an object of the present invention to provide an electron valve that controls, in a linear and/or switching mode of operation, the amount of current incoming from a power source and outputted to a load, based not on a current amplification (i.e., transistor), but indirectly, via a voltage/current conversion, with respect to an internal zero voltage reference.

It is still another object of the present invention to provide an electron valve that can control in a self-switching mode of operation the maximum and/or the effective voltage value of a pulse power wave delivered to a load, based not on an avalanche phenomenon (i.e., thyristor), but by means of an internal mono, window, or poly comparison.

It is yet another object of the present invention to provide (under the "Benistor" name) a controllable electron valve that can act as a linear valve (i.e., transistor), as a self-switching valve (i.e., thyristor), or simultaneously as both, by means of an internal "Blockading of the Electric Network."

It is also an object of the present invention provide an electron valve (Benistor) that comprises separate electrodes in order to control, respectively, the amount of current, the maximum, and/or the effective voltage value incoming from a power source and outputted to a load.

It is a further object of the present invention to provide a controllable electron valve (Benistor) that, in order to control the amount of current and/or voltage delivered to a load, requires only a fixed or variable voltage reference source inputted at its large impedance control electrodes, where the input current is negligible.

It is another object of the present invention to provide a controllable electron valve (Benistor) that, technologically, may be a vacuum Benistor, a bipolar Benistor, or a hybrid Benistor, upon a specific electronic circuit.

It is still another object of the present invention to provide a controllable electron valve (Benistor) having different polarity that may be a positive, a negative, or universal Benistor, based on the specific function required for a circuit, such as a rectifier, a variable resistor or a bilateral electronic switch.

It is yet another object of the present invention to provide a controllable electron valve (Benistor) that comprises an internal protection circuit against over-voltage and reverse current for all its control electrodes.

It is also another object of the present invention to provide a controllable electron valve (Benistor) that is based on a block schematic diagram comprising four functional blocks, such as: a "power controller", a "current separator", a "current controller", and a "voltage threshold controller."

It is another object of the present invention to provide a controllable electron valve (Benistor) that, structurally, may be a monoblock (monolithic) circuit that does not require a DC power supply (i.e., as a component), or a polyblock circuit that does require one or more DC power supplies (as an apparatus).

It is still another object of the present invention to provide a "no external control" electron valve (Benistor) that comprises three external electrodes, such as: a power input electrode "$V_{IN}$," a power output electrode "$V_{OUT}$," and a common electrode "CE," which Benistor for the remainder of this description may be referred to as a "three-terminal Benistor."

It is a further object of the present invention to provide an electrode valve (Benistor) that is controlled by voltage reference sources inputted at its internal or external control electrodes, with respect to an internal common electrode ("CE"), as a zero voltage reference, and not necessarily with respect to the ground connection of the external circuit.

It is also another object of the present invention to provide a "Five-Way External control" electron valve (Benistor) that comprises the same three basic electrodes, "$V_{IN}$", "$V_{OUT}$", and "CE", as well as five control electrodes, "cc", as an inverting current control electrode, "cc", as a non-inverting current control electrode, "SS", as a switch select electrode, "OFF/ON" as a self-switching effective voltage control electrode, and "ON/OFF", as a self-switching maximum voltage control electrode, which Benistor for the remainder of this description may be referred to as a "Classic Benistor."

It is yet another object of the present invention to provide a "mono-external control" electron valve (Benistor) that comprises only one of the Classic Benistor's control electrodes and that, for the remainder of this description, may be referred to as an "Inverting Linear Benistor," "Non-Inverting Linear Benistor," "OFF/ON Benistor," "ON/OFF Benistor," etc.

It is also another object of the present invention to provide a "poly external control" electron valve (Benistor) that may have more than eight external electrodes by repeating, two or more times, each of the particular electrodes of the "Classic Benistor" to increase the precision and the flexibility of the control, which Benistor for the remainder of this description may be referred to as a "Double OFF/ON Benistor," "Triple ON/OFF Benistor," "Multiple $V_{out}$ Benistor," etc.

It is still another object of the present invention to provide an electronic symbol design that can make a difference between a Positive, a Negative, or a Universal Benistor, including the specific criteria for each particular external electrode of the Classic (eight electrode) Benistor.

It is still an object of the present invention to provide a "switching" electron valve (Benistor) that can control the amount of current, the voltage, and/or the work-time cycle of an incoming power pulse wave delivered to a load by means of a pre-established linear/switching threshold and/or via selecting the initial condition of an internal electronic switch.

It is a further object of the present invention to provide a "mono-comparison self-switching" electron valve (Benistor) that can control the maximum or the effective voltage value outputted to a load using only one voltage reference source for a mono-comparison with the momentary voltage value of a power pulse wave incoming at the power input electrode, and acting as a voltage conditioned "OFF/ON" or "ON/OFF" switch for the period of each power pulse.

It is still another object of the present invention to provide a "window-comparison self-switching" electron valve (Benistor) that can control the maximum and/or the effective voltage value outputted to a load using two voltage reference sources for a "parallel window" or a "series window" comparison with the momentary voltage value of a power pulse wave incoming at the power input electrode and acting as a voltage conditioned "OFF/ON" and/or "ON/OFF" double switch for the period of each power pulse.

It is also another object of the present invention to provide a "Poly-comparison self-switching" electron valve (Benistor) that can control the maximum and/or the effective voltage value outputted to a load using three or more voltage reference sources for a "Poly-Parallel," "Poly-Series," or "Poly-Mix" comparison with the momentary value of a power pulse wave incoming at the power input electrode, and acting as a voltage conditioned "OFF/ON" and/or "ON/OFF" Poly (multiple) switch for the period of each power pulse.

It is still a further object of the present invention to provide a controllable electron valve (Benistor) that can work in a "feedback" mode of operation, using the voltage of one of its electrodes as a fixed or variable reference source for another one that acts as a control electrode.

It is also a further object of the present invention to provide a controllable electron valve (Benistor) that can work in a "positive feedback" mode of operation, based on an internal and/or external circuit, which creates a means for a direct proportional relationship between the amount of the voltage outputted to the load and the amount of the voltage inputted, via the feedback circuit, at the control electrode.

It is still another object of the present invention to provide a controllable electron valve (Benistor) that can work in a "negative feedback" mode of operation, based on an internal and/or external circuit, which creates a means for an indirect proportional relationship between the amount of the voltage outputted to the load and the amount of voltage inputted, via the feedback circuit at the control electrode.

It is a further object of the present invention to provide a controllable electron valve (Benistor) that can work in a "threshold feedback" mode of operation via an internal and/or external feedback circuit that includes a component having its own voltage threshold, such as silicon diodes, zener diodes, diacs, etc.

It is yet another object of the present invention to provide an electron valve (Benistor) that can control the amount of current and the maximum and/or the effective voltage value of a power pulse wave incoming from a power source and delivered to a load, via a computer (microprocessor) feedback circuit, using as an interface digital/analog circuits.

It is still another object of the present invention to provide a method and an apparatus embodiment for a "hybrid, polyblock, parallel comparison, non-inverting" Benistor.

It is also another object of the present invention to provide a method and a component embodiment for a "hybrid, monoblock, series comparison, double OFF/ON"Benistor.

It is yet another aspect of the present invention to provide a method and a component embodiment for an "inverting linear" Benistor.

It is also a further object of the present invention to provide monolithic embodiments for a "Three-Terminal Linear" Benistor, a "Three-Terminal OFF/ON" Benistor, and a "Three-Terminal ON/OFF" Benistor.

To achieve these and other advantages, and in accordance with the purpose of the present invention, as embodied and broadly described herein, the present invention is a controllable electron valve. The electron valve comprises a power controller for controlling a voltage across said load circuit, an input current being introduced to said power controller via an input voltage ($V_{IN}$) electrode, said input current being generated by said input power source, said input current including a load current and an internal current ($I_{IN}$), said load current being output by said power controller to said load circuit, $I_{IN}$ being output via a switching output; a current controller for maintaing I at a constant value, said current controller having an output coupled to a ground, having an input, and having at least one current control electrode; a voltage threshold controller for outputting a threshold current, said voltage threshold controller having at least one input and at least one output; and a current separator for controlling the passage of $I_{IN}$ and said threshold current to said constant current source, a first input of said current separator being coupled to said switching output of said power controller, a second input of said current separator being coupled to said output of said voltage threshold controller, an output of said current separator being coupled to said input of said current controller.

In another aspect the invention provides a method for controlling energy delivered to a load, which comprises generating a threshold voltage and a threshold current; controlling an output voltage across said load, including: generating an input current and an input voltage, said input current including a load current and an internal current, introducing said input current into a power controller, outputting said load current to said load, outputting said internal current from said power controller, wherein said output voltage is a function of said input voltage and is dependent on said threshold voltage, wherein said power controller has a gain and said load current has a proportional relationship to said internal current relative to said gain, and wherein said power controller has a saturation current, said saturation current being a constant value; maintaining said internal current at a constant value, such that the sum of said internal current and said threshold current is equal to said saturation current; and controlling the flow of said internal current and said threshold current, such that at least one of either said internal current or said threshold current flows to a ground.

The invention consists in the novel parts, constructions, arrangements, combinations and improvements herein shown and described. The above-stated and other objects and advantages of the invention will become apparent from the following description when taken with the accompanying drawings. It will be understood, however, that the drawings are for purposes of illustration and are not to be construed as defining the scope or limits of the invention, reference being had for the latter purpose to the claims appended hereto.

Additional objects, features, and advantages of the invention will be set forth in the description that follows, and in part will be apparent from the description, or may be learned by practice of the invention. The objective and other advantages of the invention will be realized and attained by the apparatus and method particularly pointed out in the written description and claims hereof, as well as the appended drawings.

It is to be understood that both the foregoing general description and the following detailed description are exemplary and explanatory only and are not restrictive of the invention as claimed.

The accompanying drawings are included to provide a further understanding of the invention and are incorporated in and constitute a part of this specification. In addition, the accompanying drawings illustrate the embodiments of the invention and, together with the description, serve to explain the principles of the invention.

BRIEF DESCRIPTION OF THE DRAWINGS

Like reference numbers and designations in the various drawings refer to like elements.

DESCRIPTION OF THE PREFERRED EMBODIMENTS

Figure 1B:
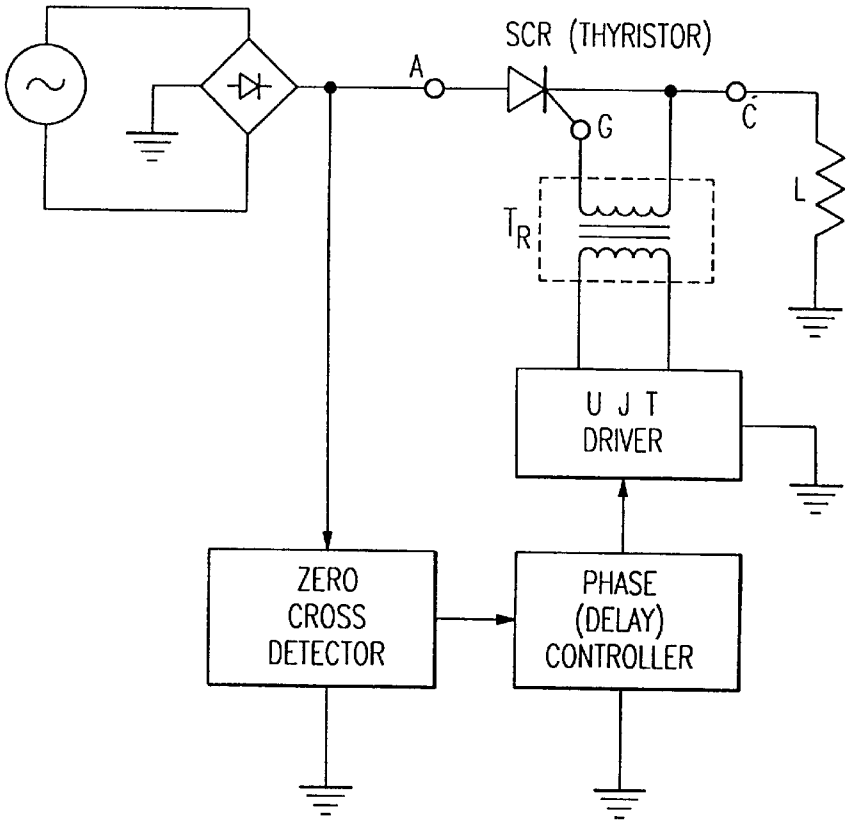
FIG. 1B PRIOR ART
FIG. 1B is a block schematic of a prior art SCR's classic AC circuit.
Figure 1A:
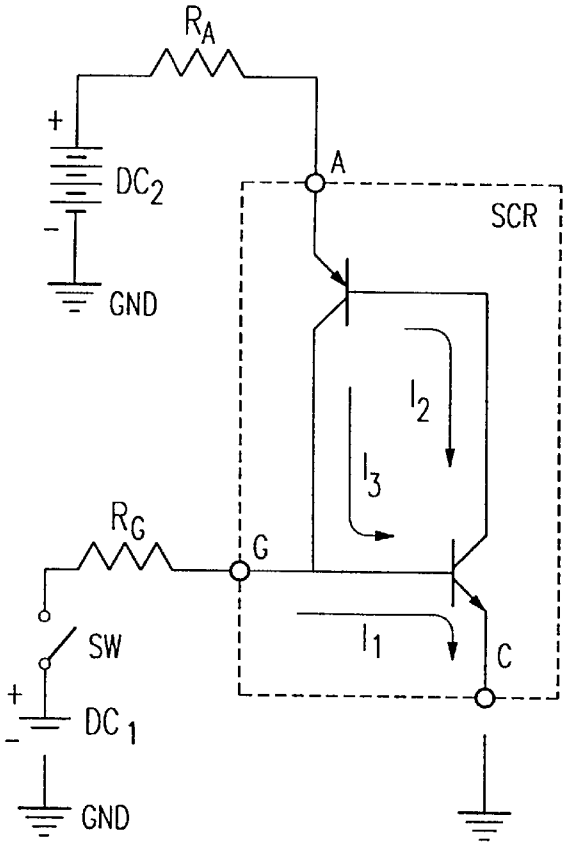
FIG. 1A PRIOR ART
FIG. 1A is a schematic diagram representative of a prior art SCR internal equivalent circuit.

Reference will now be made in detail to the present preferred embodiments of the invention, examples of which are illustrated in the accompanying drawings. Wherever possible, the same reference numerals will be used throughout the drawings to refer to the same or like parts.

In accordance with the present invention, a controllable electron valve is provided. For the remainder of this description, the controllable electron valve of the present invention may be referred to as a "Benistor", even though it may control the output current in linear mode of operation, like a transistor, and the output voltage in a self-switching mode of operation, like a thyristor. The "BEN" portion of the term "Benistor" derives from the Romanian, Blocare Electronica de Nivel, which translates to blockaded electronic threshold. This means blocking an electronic circuit with respect to a threshold, or in English, blockading the electric network.

The Benistor is a controllable electron valve that can control, separately or simultaneously, the current, the maximum voltage, and/or the effective voltage incoming from a power source to a load in a linear or switching mode of operation or in a self-switching mode of operation. Such control is accomplished in the linear or switching mode based on an internal voltage/current conversion by means of pre-established linear/switching thresholds, and/or in the self-switching mode based on an internal voltage comparison of the power input electrode and the voltage control electrodes.

1. General Description of Various Embodiments of the Benistor

Figure 2A:
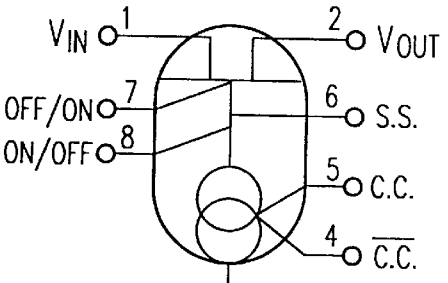
FIG. 2A is an electronic symbol design for the positive OFF/ON Benistor embodiment of the present invention.

FIGS. 2A to 2F illustrate electronic symbols for six variations of the Benistor. FIG. 2A shows the "Classic" Benistor having eight electrodes: a voltage input "$V_{IN}$" electrode 1, a voltage output "$V_{OUT}$" electrode 2, a common "CE" electrode 3, an inverting current control, "cc" 4, a non-inverting current control electrode, "cc" 5, a switch selector control electrode "SS" 6, an effective voltage self-switching control electrode "OFF/ON" 7, and a maximum voltage self-switching control electrode "ON/OFF" 8. The figures suggest that the Benistor controls simultaneously and/or separately the output current or voltage, and the position of the various electrodes denominate the function of each of them. In other words, in a schematic diagram, the Benistor's symbol and the position of the electrodes will illustrate, alone, the particular function of each electrode.

Figure 2B:
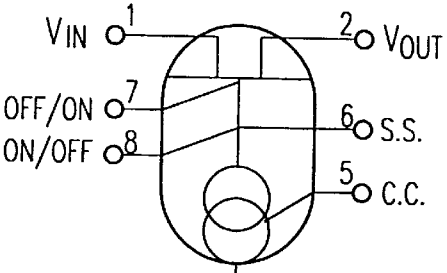
FIG. 2B is an electronic symbol design for the negative ON/OFF Benistor embodiment of the present invention.

FIG. 2B illustrates an "Inverting Classic" Benistor, which does not have the noninverting current control input electrode, "cc" 5.

Figure 2C:
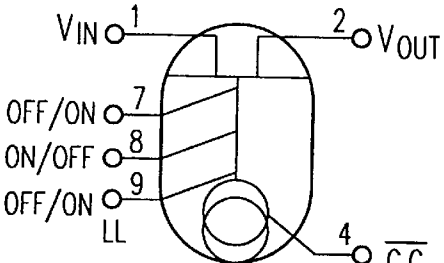
FIG. 2C is an electronic symbol design for the universal Linear Benistor embodiment of the present invention.

FIG. 2C shows a "Double OFF/ON" Benistor's symbol, having one more "OFF/ON" (9) electrode that replaces the "SS" electrode 6.

Figure 2D:
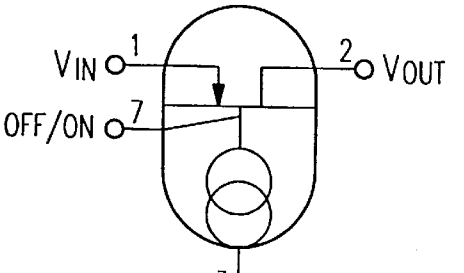
FIG. 2D is an electronic symbol design for the Classic Benistor embodiment of the present invention.

FIG. 2D illustrates a "Positive OFF/ON" Benistor. This embodiment may comprise only the "OFF/ON" electrode 7 for voltage control. An arrow placed on the "$V_{IN}$" electrode 1 symbolizes that only a positive current is accepted as a power input.

Figure 2E:
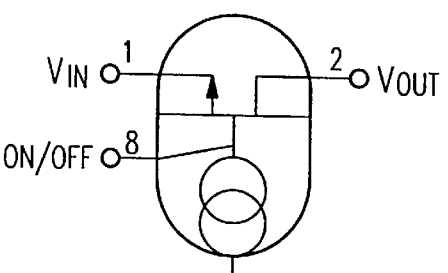
FIG. 2E is an electronic symbol design for the Double OFF/ON Benistor embodiment of the present invention.

FIG. 2E illustrates a "Negative ON/OFF" Benistor. This embodiment comprises only the "ON/OFF" electrode 8 for voltage control. An arrow placed on the "$V_{IN}$" electrode 1 symbolizes that only a negative current is accepted as a power input.

Figure 2F:
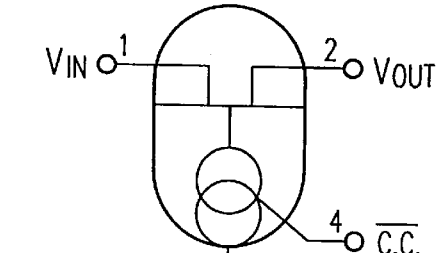
FIG. 2F is an electronic symbol design for the Three-Terminal Benistor embodiment of the present invention.

FIG. 2F illustrates an "Inverting Universal" Benistor. This embodiment comprises only the "cc" electrode 1. The fact that no arrow is placed on the "$V_{IN}$" electrode 1 symbolizes that any current, positive or negative, is accepted as a power input. The voltage-in electrode 1, "$V_{IN}$", inputs the entire power (voltage and current) from a variable (pulse) power source. Also the voltage and current input at $V_{IN}$ electrode 1 provides momentary values used for internal comparisons and/or switching operations. This electrode is exposed to the largest variation of voltage and current, up to the limits of the component, and must be internally protected from a reverse current.

The voltage out electrode 2, "$V_{OUT}$", delivers to a load a percent or the entire power input at the $V_{IN}$ electrode 1. The output current of $V_{OUT}$ 2 is indirectly proportional to the voltage value input at the current control "cc" electrode 6; the output effective voltage value of $V_{OUT}$ 2 is indirectly proportional to the voltage value input at the "OFF/ON" electrode 7; and the maximum voltage value of $V_{OUT}$ 2 is the same as the voltage value input at the "ON/OFF" electrode 8. The $V_{OUT}$ electrode 2 is exposed to almost the same variations of voltage and current as the "$V_{IN}$" electrode 1 and must be protected from a reverse current.

The common electrode 3, "CE", delivers to ground the cumulative value of all small internal control currents and represents the "zero reference" for the voltage value of the reference sources inputting to the three control electrodes. When CE 3 is not connected to ground it can become a control electrode itself, used as a non-zero reference. In that situation CE 3 is exposed to large variations of voltage and must be externally protected from a reverse current.

The effective voltage control electrode 7, "OFF/ON", by inputting a fixed or variable voltage, controls the effective voltage value output at the $V_{OUT}$ electrode 2 without affecting the maximum voltage value of the power wave input at the $V_{IN}$ electrode 1. The impedance of the voltage control electrode 7 must be large enough to create a negligible input current; it must admit internally at least the same variations of voltage admitted by the $V_{IN}$ 1 electrode; and it must be internally protected from a reverse current. When the momentary voltage value at the $V_{IN}$ electrode 1 is less than the reference voltage at the OFF/ON electrode 7, there will be no voltage output at the $V_{OUT}$ electrode 2, and when the momentary voltage value at the $V_{IN}$ electrode 1 is greater than the reference voltage at the OFF/ON electrode 7, a predetermined effective voltage will be output at the $V_{OUT}$ electrode 2.

The "ON/OFF" electrode 8, by inputting a voltage value, limits the maximum voltage value at the $V_{OUT}$ electrode 2 to the same reference voltage input at the ON/OFF electrode 8. The impedance of the ON/OFF electrode 8 must be large enough to provide for negligible input current; it must admit internally at least the same variations of voltage admitted by the $V_{IN}$ electrode 1; and it must be internally protected from a reverse current. When the momentary voltage at the $V_{IN}$ electrode 1 is less than the reference voltage at the ON/OFF electrode 8, a predetermined voltage will be output at the $V_{OUT}$ electrode 2, and when the momentary voltage value at the $V_{IN}$ electrode 1 is greater than the reference voltage at the ON/OFF electrode 5, there will be no voltage output at the $V_{OUT}$ electrode 2.

The inverting current control electrode 4, "cc", by inputting a fixed or variable voltage, controls the output (load) current. Inputting a linearly increasing voltage at the cc electrode 4 between zero and a pre-established voltage (less than 1 volt) will linearly decrease the output current from a preestablished maximum value to zero, and the output current will remain at zero, despite further increases of voltage at the cc electrode 4. The cc electrode 4 has a large impedance and internally admits at least the same variations as the $V_{IN}$ electrode 1. (The current is negligible.) The cc electrode 4 must be internally protected from a reverse current.

The non-inverting current control electrode 5, "cc", by inputting a fixed or variable voltage, controls the output (load) current. Inputting a linearly increasing voltage at the cc electrode 5 between zero and a pre-established voltage (less than 1 volt) will linearly increase the output current from zero to a pre-established maximum value, and the output current will remain at maximum value despite further increases of voltage at the cc electrode 5. The cc electrode 5 has a large impedance and internally admits at least the same variation of voltage as the $V_{IN}$ electrode 1. (The current is negligible.) The cc electrode 5 must also be protected from a reverse current.

The switch selector electrode 6, "SS", determines the work time/cycle of the Benistor—respectively, the number of "ON" times against the number of "OFF" times when the Benistor is acting in the self-switching mode of operation—during a power pulse cycle. The SS electrode 6 has only two positions: (1) "in air" (not connected to ground) or (2) grounded (connected to ground). Depending on which position is chosen, the work time/cycle will be predominantly "ON" or predominantly "OFF."

2. Description of the Block Schematic Diagram

Figure 2G:
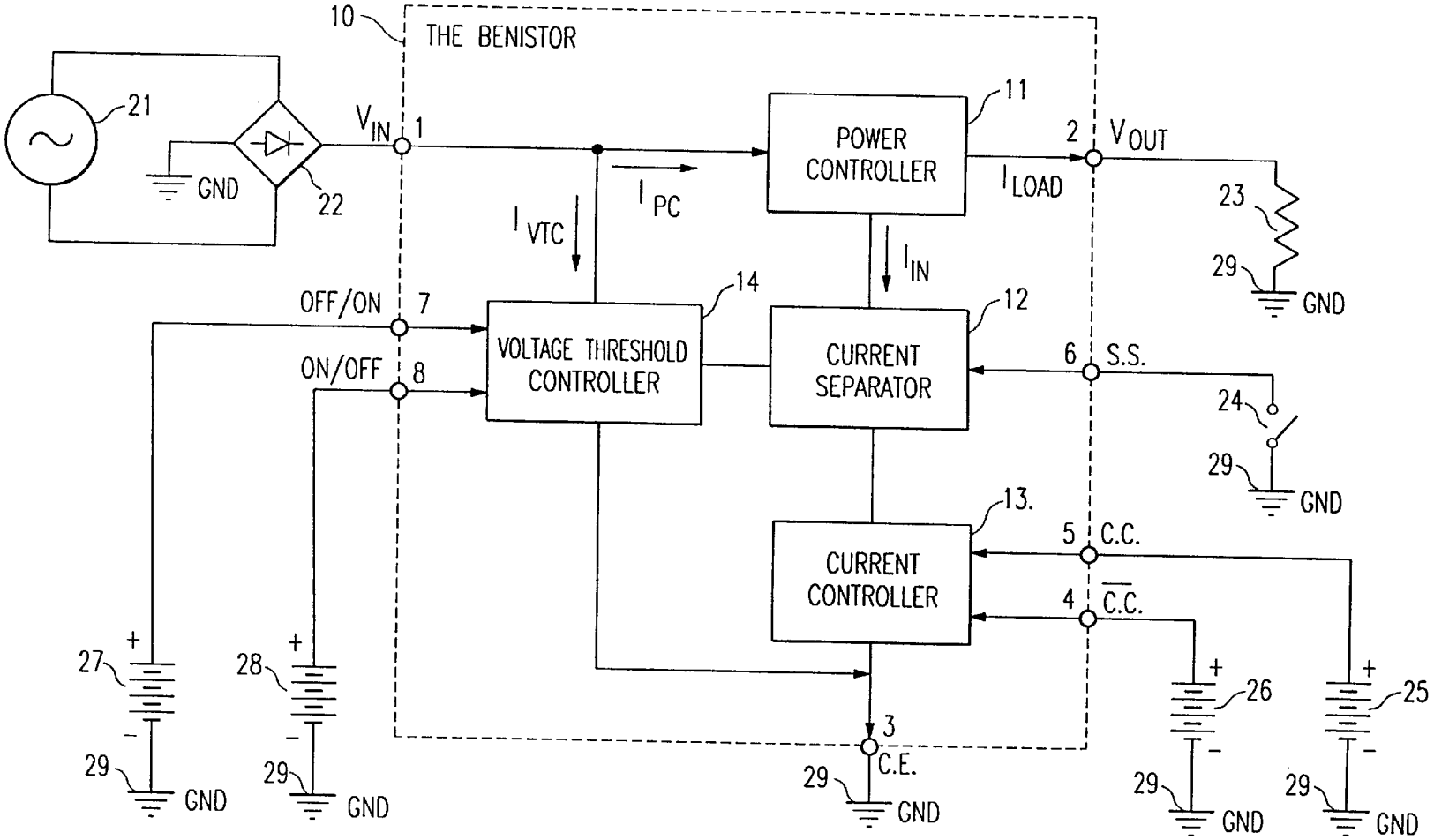
FIG. 2G is a block schematic diagram of the Classic Benistor embodiment of the present invention.

The block schematic diagram of the Benistor is illustrated in FIG. 2G and is designated generally by reference numeral 10. The Benistor 10 comprises a Power Controller 11, a Current Separator 12, a Current Controller 13, and a Voltage Threshold Controller 14.

As embodied herein, the Power Controller 11 is connected to the $V_{IN}$ electrode 1, which is in turn connected to a positive pole of a rectified bridge 22. The negative pole of the rectified bridge 22 is connected to ground 29. The other two terminals of the rectified bridge 22 are connected to an AC power source 21. The Power Controller 11 is also connected to the $V_{OUT}$ electrode 2, which is connected to a resistive load 23, and the load 23 is connected to ground 29. The Power Controller 11 is internally connected to the Current Separator 12.

The Current Separator 12 is externally connected to a switch 24 via the switch selector (SS) electrode 6. The other connection of the external switch 24 is connected to ground 29. The Current Separator 12 is internally connected to the Current Controller 13 and the Voltage Controller 14.

The Current Controller 13 is externally connected to the positive pole of a first voltage reference source 25 via the non-inverting cc electrode 5, to the positive pole of a second voltage reference source 25 via the inverting cc electrode 4, and to ground 29 via the common electrode (CE) 3. The negative pole of both voltage reference sources 25 and 26 are connected to ground 29.

The Voltage Threshold Controller 14 is internally connected to the $V_{IN}$ electrode 1 and to the common electrode (CE) 3, which is connected to ground 29. The Voltage Threshold Controller 14 is externally connected to the positive pole of a third voltage reference source 27 via the effective voltage control OFF/ON electrode 7 and to a fourth voltage reference source 28 via the maximum voltage control ON/OFF electrode 8. The negative pole of each voltage reference source 27, 28 is connected to ground 29.

As further embodied herein, a power pulse wave inputted at $V_{IN}$ electrode 1 creates two currents, "$I_{vtc}$" (voltage threshold controller), and "$I_{pc}$" (power controller). The value of $I_{vtc}$ is small, nearly constant over time, and acts to create an internal reference voltage. The $I_{pc}$ in turn divides to become two currents: a larger current, $I_{LOAD}$ (or load current), and a smaller current $I_{IN}$ (or internal current). $I_{LOAD}$ is the largest current inside the component and is externally limited by the load's resistive value (Ohm's Law) and internally limited by the Current Controller 13. The amount of the internal current $I_{IN}$ is dependent upon the internal structure of the Power Controller 11 and the Current Separator 12. The $I_{IN}$ is variable between a few micro amperes, if the Power Controller 11 employs FET technology, and several mili amperes, if the Power Controller employs bipolar technology.

As embodied herein, the Power Controller 11 acts as a buffer for the entire component and is comprised of one or more transistors (bipolar, Darlington, MOS, FET, or hybrids) or SCRs. The Power Controller 11 acts as a switch with zero resistance when in the "ON" condition and with infinite resistance when in the "OFF" condition. The Power Controller 11 also accepts, as a dynamic resistor, linear variations from zero to infinity. The speed of commutation, the thermal coefficient, and the maximum internal power dissipation of this block are also important parameters.

The Current Separator 12 provides a means for the Voltage Controller 14 and Current Controller 13 to control, simultaneously or separately, the Power Controller 11 and prevents reverse current from entering the Power Controller 11, the Current Controller 13, and the Voltage Threshold Controller 14. The Current Separator 12 also controls the work time/cycle of the Power Controller 11 via the switch selector SS electrode 6. These functions may be performed by electronic switches, bipolar, FET, or MOS transistors, commutation diodes, zener diodes, etc.

The Current Controller 13 functions to provide to the Power Controller 11 a linear variation of current from zero to the limits accepted by the components of the Power Controller 11. The Current Controller 13 acts as a voltage/current converter for the Power Controller 11. The voltage inputted at the inverting current control electrode 4 with respect to the common electrode 3 as a zero voltage reference, is indirectly proportional to the current outputted to the load via $V_{OUT}$ electrode 2. The voltage inputted at the non-inverting current control electrode 5, with respect to the common electrode 3 as a zero voltage reference, is directly proportional to the current outputted to the load via $V_{OUT}$ electrode 2.

The components comprising the Current Controller 13 may be bipolar, FET, or hybrid transistors, constant current sources, operational amplifiers, commutation diodes, zener diodes, etc.; must keep the internal current constant for large variations of voltage; and must provide a linear threshold, before which the Power Controller 11 will operate in a linear mode and after which it will maintain the output current at zero despite further increases of the voltage input at the current control electrode 6. This linear threshold is dependent upon the comportment of the components used in the current controller 13. It is desirable, however, to have this linear threshold less than one volt, and ideally this linear threshold will be as close to zero as possible, thereby increasing the precision of the output voltage when the current control electrode 6 is acting as a reference for another electrode. The Current Controller 13 provides a means for the Power Controller 11 to function in a switching mode of operation once the aforementioned linear threshold is passed, and a square wave generator is the input source at the current control electrode 6. In this situation, as the amplitude of the square wave increases in relation to the linear threshold; the slew rate of the output of the Power Controller 11 will also increase.

As further embodied herein, the Voltage Threshold Controller 14 functions as a window comparator, having as reference voltage inputs the OFF/ON electrode 7 and the ON/OFF electrode 8, and having as a comparison voltage input the $V_{IN}$ electrode 1. The output load 23 may be an electronic switch or a current separator circuit. The Voltage Threshold Controller 14 may comprise either transistors, bipolar, MOS, FET, or hybrids, for a monoblock structure (component), or two or more comparators, operational amplifiers, etc., for a polyblock structure (apparatus). The comparison occurring between the OFF/ON electrode 7 or the ON/OFF electrode 8, and the $V_{IN}$ electrode 1 provides a means (via the Current Separator 12) for the Power Controller 11 to be either switched "OFF" or switched "ON". When the Power Controller 11 is in a switched "OFF" condition, the output at the $V_{OUT}$ electrode 2 is zero; when it is in a switched "ON" condition, the output current at the $V_{OUT}$ electrode 2 will be limited by the resistive value of the load or by the Current Controller 11 via the Current Separator 12.

Figures 6A, 6B, 6C:
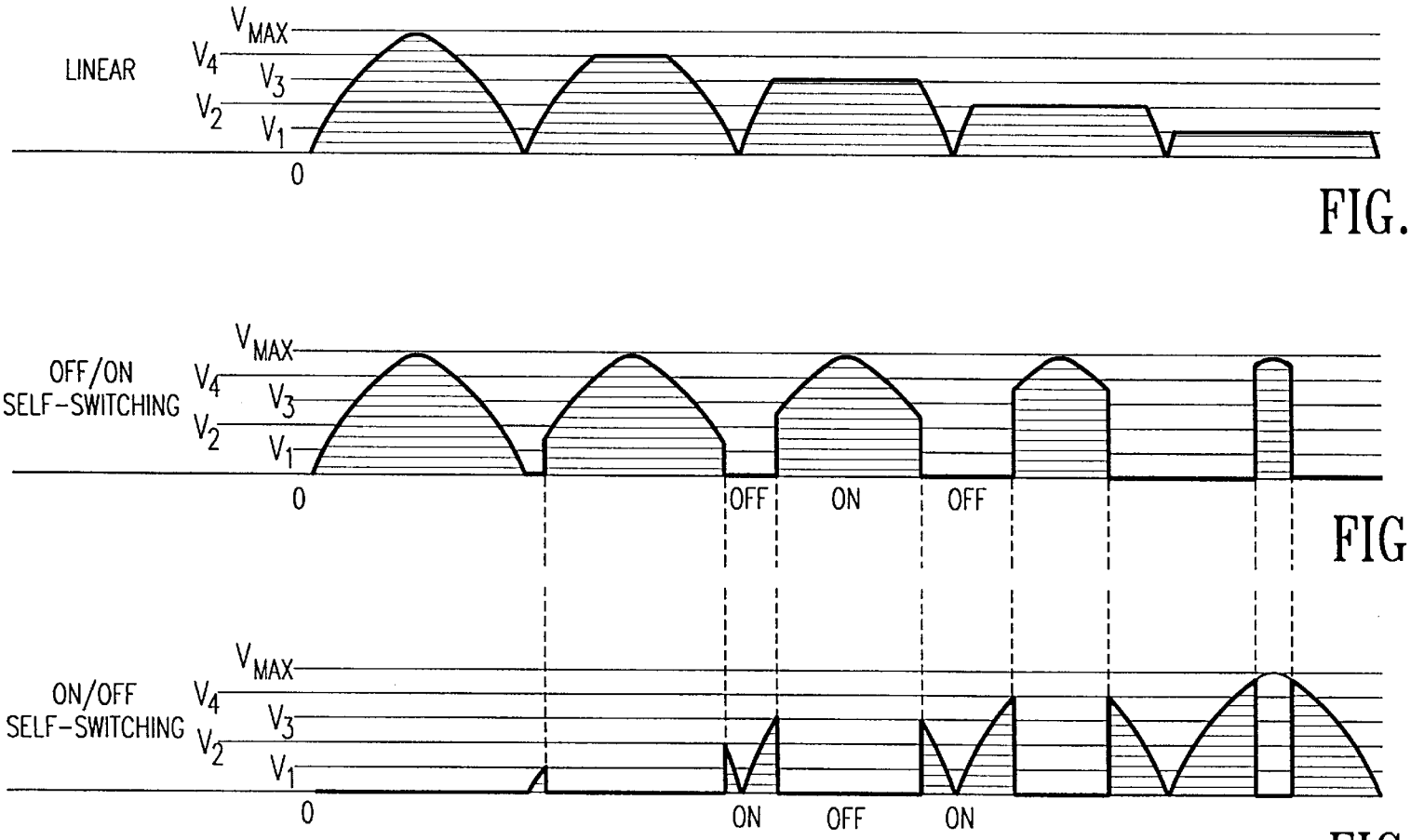
FIG. 6A is a graphical illustration of the Linear Benistor's voltage versus time.
FIG. 6B is a graphical illustration of the OFF/ON Benistor's voltage versus time.
FIG. 6C is a graphical illustration of the ON/OFF Benistor's voltage versus time.

When the electrode used for comparison with the $V_{IN}$ electrode 1 is the OFF/ON electrode 7, which inputs a DC reference voltage (with the common electrode 3 as a zero reference), the Power Controller 11 is in a switch "OFF" condition when the momentary voltage value at the $V_{IN}$ electrode 1 is less than the reference voltage at the OFF/ON electrode 7. Conversely, the Power Controller 11 is in a switched "ON" condition when the momentary voltage value at the $V_{IN}$ electrode 1 is greater than the reference voltage input at the OFF/ON electrode 7. In other words, during one complete cycle of the power wave and with the value of the reference voltage input at the OFF/ON electrode 7 as $0<V(\text{off-on})<V_{IN}(\max)$, the Power Controller 11 will be first "OFF", then "ON", and then "OFF" again. Based on this comparison, the Benistor acts as a self-switching controllable electron valve in an "OFF/ON" mode of operation. The output voltage waveform at the $V_{OUT}$ electrode 2 to a resistive load is shown in FIG. 6B and reflects a variety of reference voltages, between zero and $V_{IN}(\max)$, at the OFF/ON electrode 7.

When the electrode used for comparison with the $V_{IN}$ electrode is the ON/OFF electrode, which inputs a DC reference voltage (with the common electrode 3 as a zero reference), the Power Controller 11 is in a switched "ON" condition when the momentary voltage value at the $V_{IN}$ electrode 1 is less than the reference voltage at the ON/OFF electrode 8. Conversely, the Power Controller is in a switched "OFF" condition when the momentary voltage value at the $V_{IN}$ electrode 1 is greater than the reference voltage at the ON/OFF electrode 8. In other words, during one complete cycle of the power wave and with the value of the reference voltage input at the ON/OFF electrode 8 as $0<V(\text{on-off})<V_{IN}(\max)$, the Power Controller 11 will be first "ON", then "OFF", and then "ON" again. Based on this comparison, the Benistor acts as a self-switching, controllable electron valve in an "ON/OFF" mode of operation. The output voltage waveform at the $V_{OUT}$ electrode 2 to a resistive load is shown in FIG. 6C and reflects a variety of reference voltages, between zero and $V_{IN}(\max)$, at the ON/OFF electrode 8.

Figure 1D:
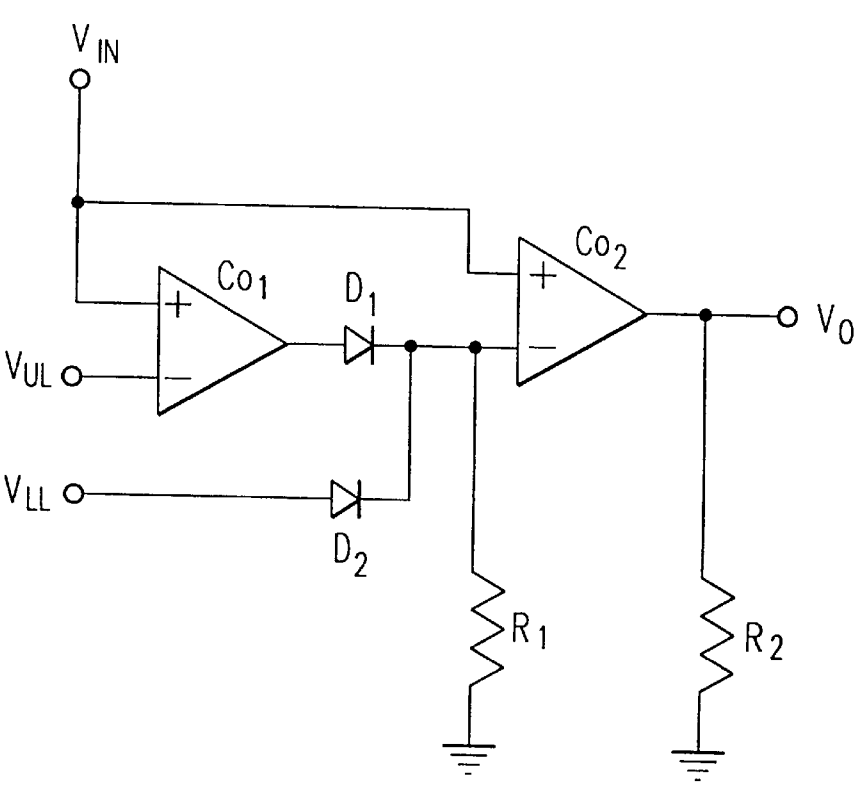
FIG. 1D PRIOR ART
FIG. 1D is a prior art series window comparator.
Figure 1C:
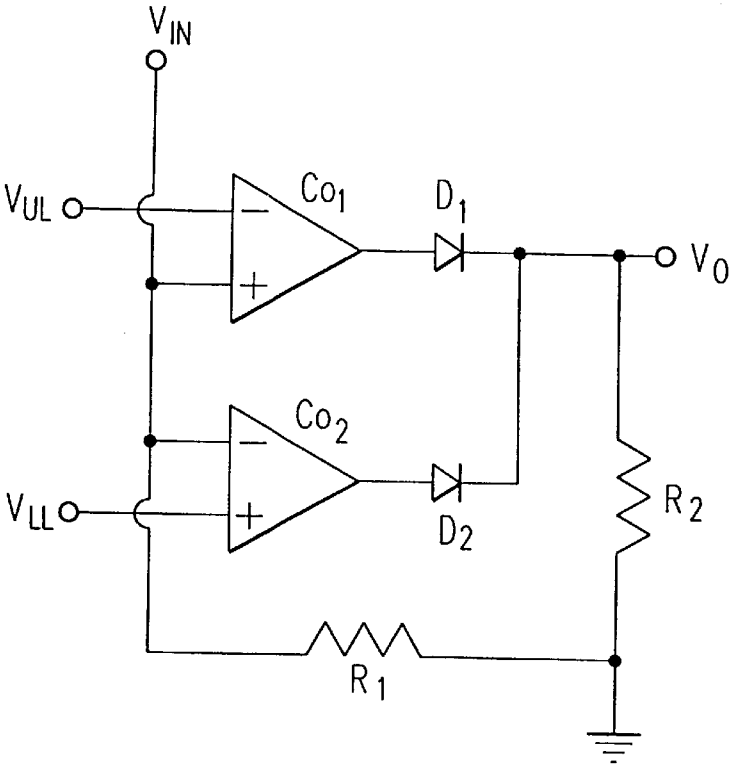
FIG. 1C PRIOR ART
FIG. 1C is a prior art parallel window comparator.

In order to explain the self-switching mode of operation of the Benistor when both voltage control electrodes are simultaneously inputting two different reference voltages, a review of the window comparator mode of operation is provided. A window comparator, also referred to as a "double ended comparator," is a circuit that detects whether or not an input voltage is between two specified voltage limits, called a window. As shown in FIG. 1C, this is normally accomplished by logically combining the outputs from both an inverting and a non-inverting comparator. When the input level is greater than the upper reference voltage (VUL) the window, or less than the lower reference voltage (VLL) of the window, the output of the circuit is at VMAX. If the level of the input voltage is in the window between VLL and VUL, the output voltage is zero. In summary:

Rule 1: $V_{OUT}$=0, when VLL<$V_{IN}$<VUL.

Rule 2: $V_{OUT}$=VMAX, when $V_{IN}$<VLL or $V_{IN}$>VUL.

Based on Rules 1 and 2 above, the state of the window comparator's output can be anticipated for any combination of the momentary voltage at $V_{IN}$ with respect to the reference voltages input as VUL and VLL, or for any combination of the reference sources VUL and VLL with respect to ground (zero voltage) or to the maximum voltage in the circuit (VMAX).

In a first particular condition (A), during which the $V_{IN}$ trip from a rectified bridge is a cyclic pulse, from zero to a maximum voltage and back to zero, and the parameters are defined as follows—0<$V_{IN}$<VMAX, VLL<VUL<VMAX, and 0<VLL<VUL (the upper level voltage being less than VMAX but larger than the lower level voltage, and the lower level voltage being larger than zero)—five situations are possible:

Situation 1: 0<$V_{IN}$<VLL. In this situation, $V_{IN}$ is outside of the window. Therefore, based on Rule 2 above, the window comparator's output will be at VMAX, and the logic state will be "HI".

Situation 2: VLL<$V_{IN}$<VUL. In this situation, $V_{IN}$ is inside of the window. Therefore, based on Rule 1 above, the window comparator's output will be zero voltage, and the logic state will be "LO".

Situation 3: VUL<$V_{IN}$<VMAX. In this situation, $V_{IN}$ is outside of the window. Therefore, based on Rule 2 above, the window comparator's output will be at VMAX, and the logic state will be "HI".

Situation 4: VLL<$V_{IN}$<VUL. In this situation, $V_{IN}$ is again inside of the window. Therefore, based on Rule 1 above, the window comparator's output will be at zero, and the logic state will be "LO".

Situation 5: 0<$V_{IN}$ <VLL. In this situation, $V_{IN}$ is outside of the window. Therefore, based on Rule 2 above, the window comparator's output will be at VMAX, and the logic state will be "HI".

In summary, $V_{OUT}$ has five alternating logic states for each cycle of the input wave. These logic states are: HI to LO to HI to LO to HI.

Besides condition (A) described above, four more particular conditions are possible: (B) VLL=0. In condition (B), when the lower level is zero (VLL electrode is grounded), situations 1 and 5 above are not possible. Therefore, $V_{OUT}$ has only three alternating logic states per cycle, namely, LO to HI to LO. (C) VUL=VMAX. In condition (C), when the upper level voltage equals the maximum voltage, situation 3 above cannot occur. Therefore, $V_{OUT}$ has three alternating logic states per cycle, namely, HI to LO to LO to HI, which equals HI to LO to HI. (D) VLL<VUL (including VLL=VMAX and VUL =0). In condition (D), when the lower level electrode voltage value is greater than the upper level electrode voltage value, no window is possible and situations 2 and 4 are not possible. Therefore, $V_{OUT}$ has only one output state for the entire logic cycle: namely, HI. (E) VLL=VUL (or VLL=0 and VUL=VMAX). In condition (E), when the lower level voltage is equal to the upper level voltage, the window encompasses zero to VMAX. Therefore, situations 1, 3, and 5 above are not possible, and $V_{OUT}$ has only one output state for the entire logic cycle: namely, LO.

Based on these principles of operation of a window comparator and outputting to the Current Separator 12 (as an electronic switch or a current separator circuit), the two logic states, HI and LO, will be converted to a switched "ON" or switched "OFF" command to the Power Controller 11. The structure of the Power Controller 11 determines the way in which the Current Separator 12 converts the logic state (HI or LO) from the Voltage Threshold Controller 14, to a form of voltage and/or current required by the components of the Power Controller 11 to act as an electronic switch. The condition of this switch may be ON when the logic state is HI, and OFF when the logic state is LO, or vice versa based on the switch's internal structure.

Figure 5A:
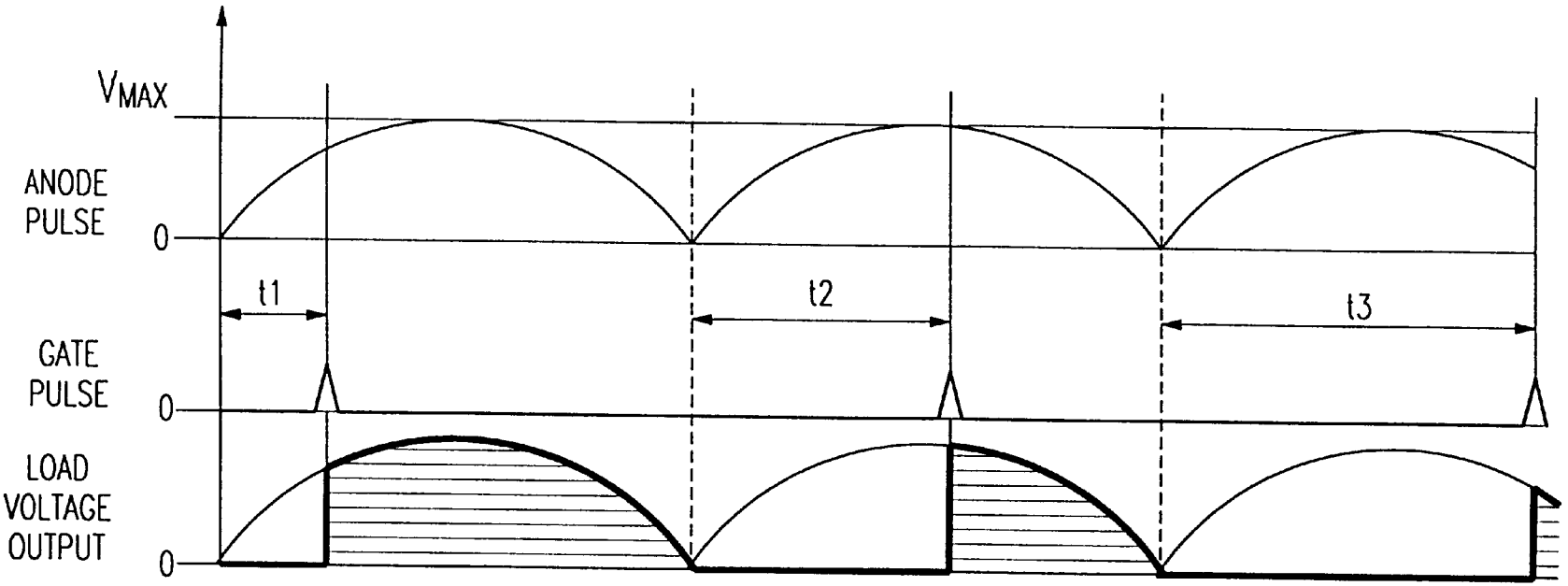
FIG. 5A PRIOR ART
FIG. 5A is a graphical illustration of the prior art thyristor's voltage versus time.
Figure 5B:
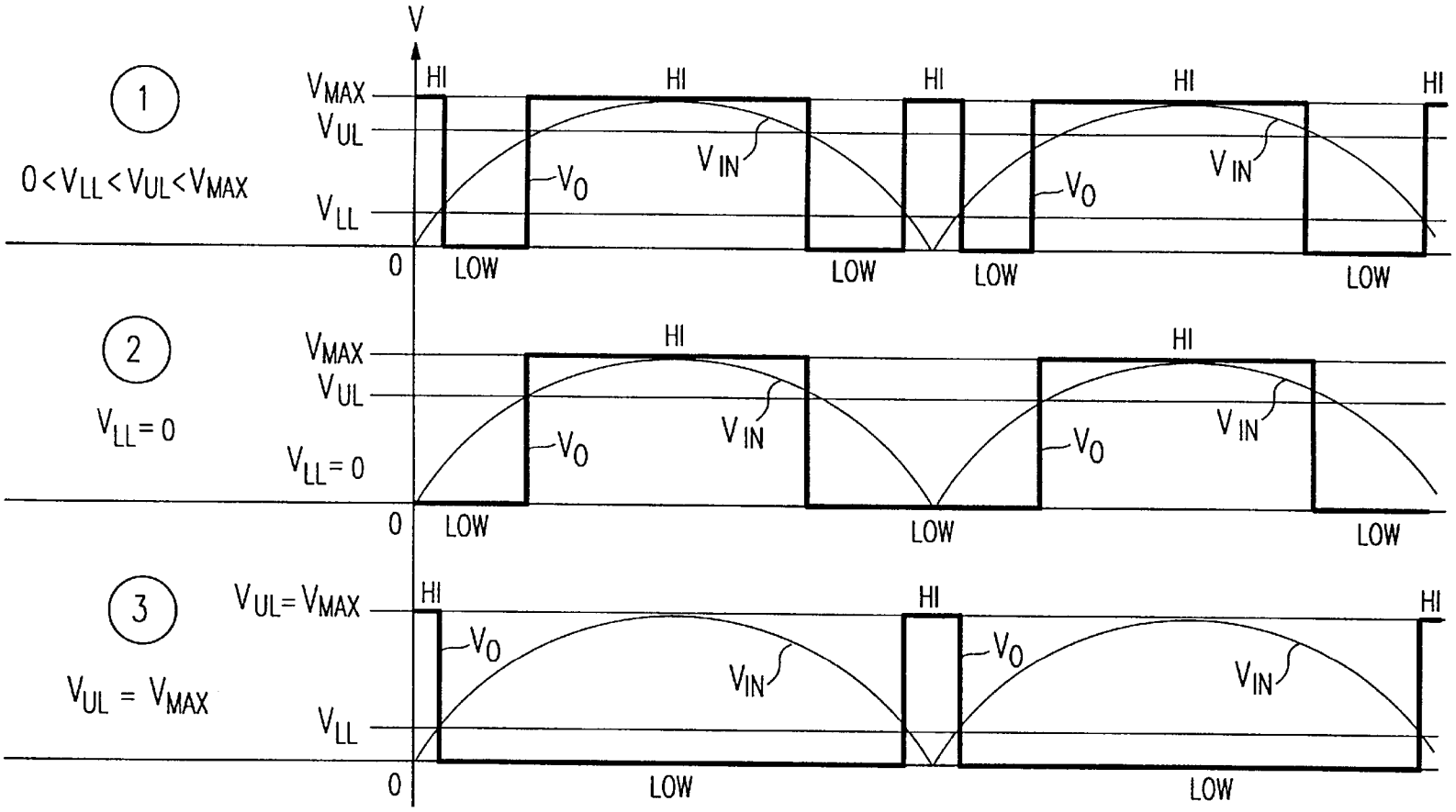
FIG. 5B PRIOR ART
FIG. 5B is a graphical illustration of the prior art parallel window comparator.
Figure 5C:
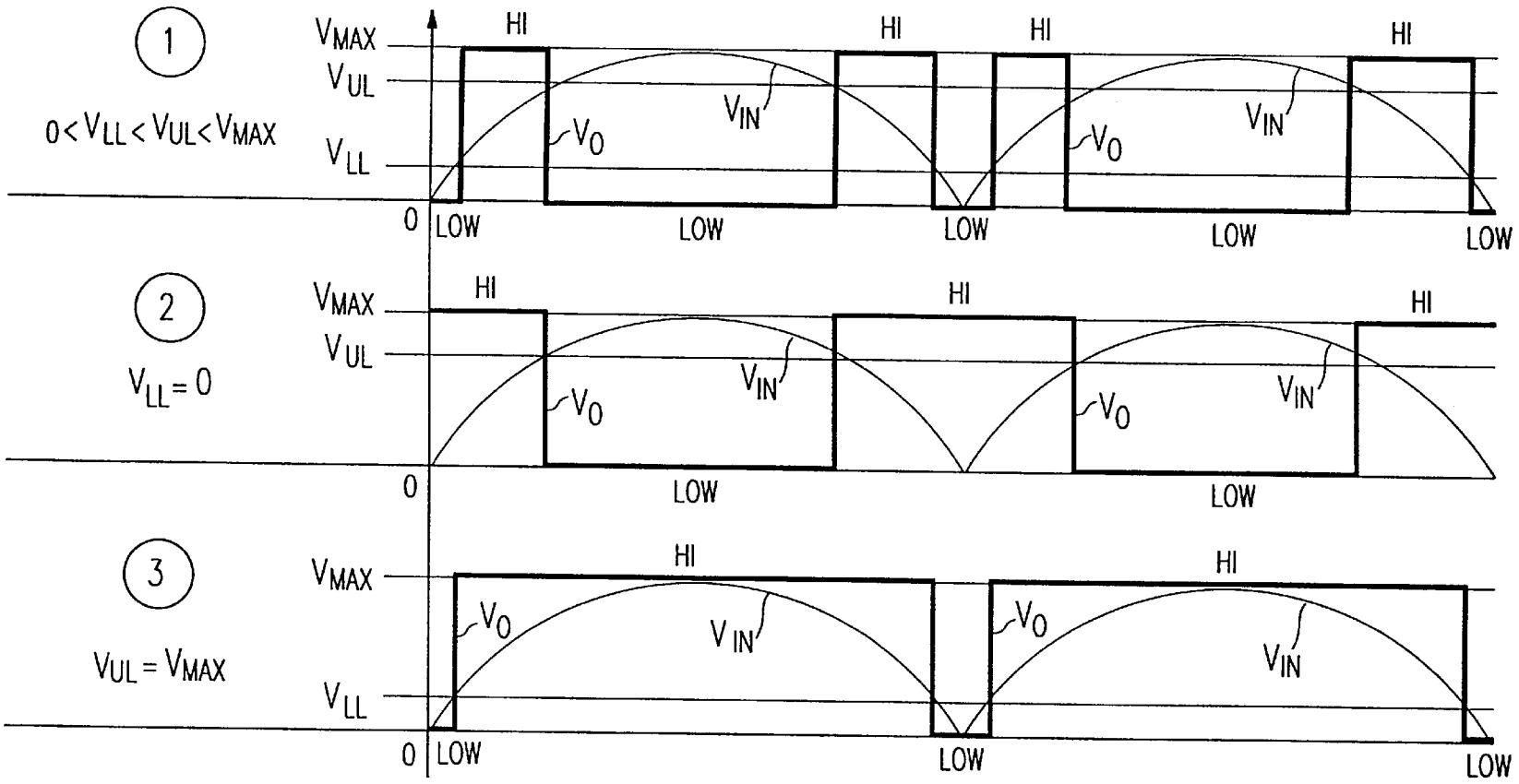
FIG. 5C PRIOR ART
FIG. 5C is a graphical illustration of the prior art series window comparator.

As the prior art graphs in FIG. 5C illustrate, a window comparator in a serial configuration of two inverting comparators (see FIG. 1D) will produce logic output states that are in an opposite phase of those produced by a window comparator in a parallel configuration (as shown in FIG. 5B). Therefore, if the voltage threshold controller 14 contains a window comparator as illustrated in FIG. 1D, Condition a as stated above can be summarized as follows: $V_{OUT}$ will have five alternating logic states for each cycle of the input wave, these being LO to HI to LO to HI to LO. Also, all the other particularly situations will be in the opposite phase with respect to the parallel window comparators voltage against time output graphs.

Figure 6D:
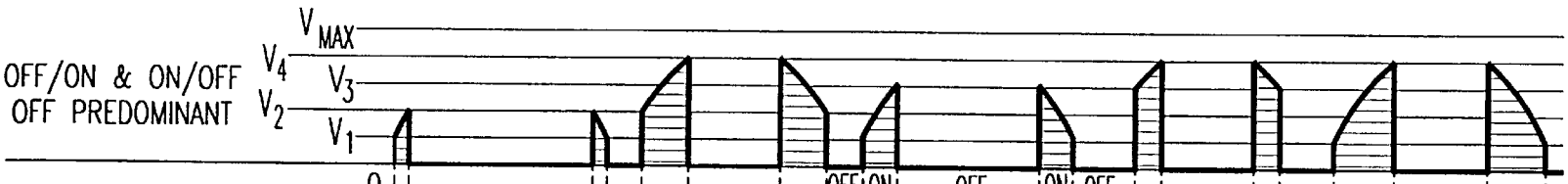
FIG. 6D is a graphical illustration of the OFF/ON/OFF combination Benistor's voltage versus time.
Figure 6E:
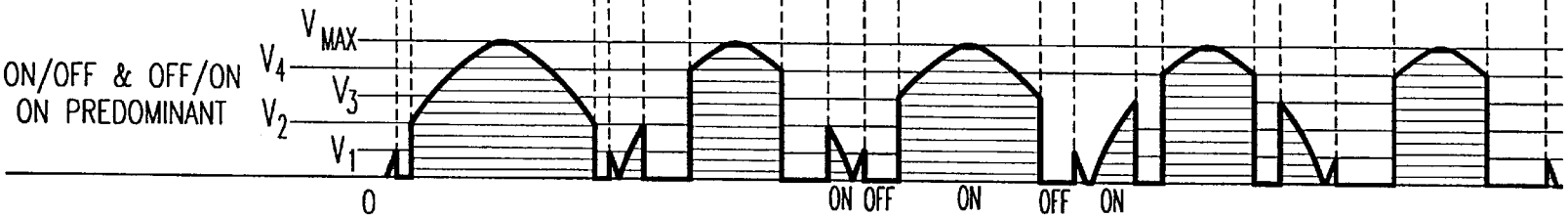
FIG. 6E is a graphical illustration of the ON/OFF/ON combination Benistor's voltage versus time.
Figure 6F:
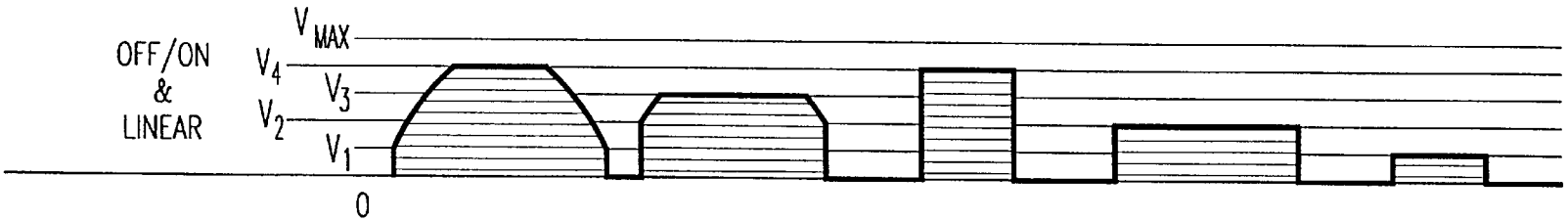
FIG. 6F is a graphical illustration of the OFF/ON/LINEAR combination Benistor's voltage versus time.
Figure 6G:
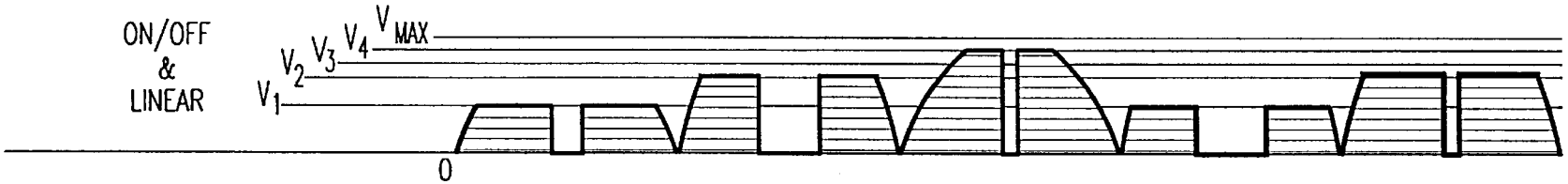
FIG. 6G is a graphical illustration of the ON/OFF/LINEAR combination Benistor's voltage versus time.
Figure 6H:
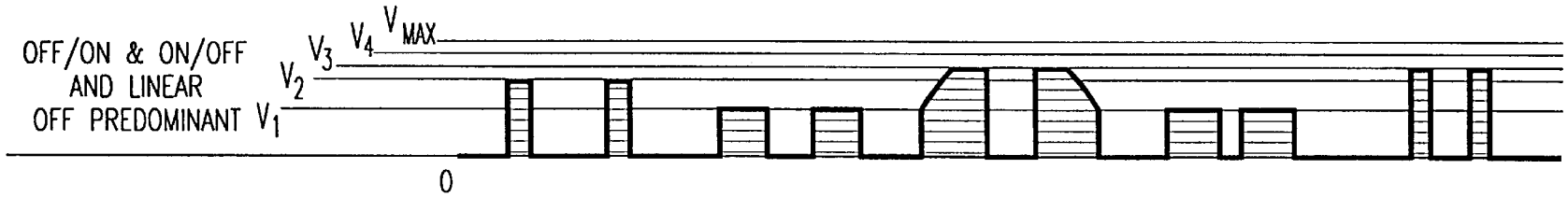
FIG. 6H is a graphical illustration of the OFF/ON/OFF/LINEAR combination Benistor's voltage versus time.
Figure 6I:
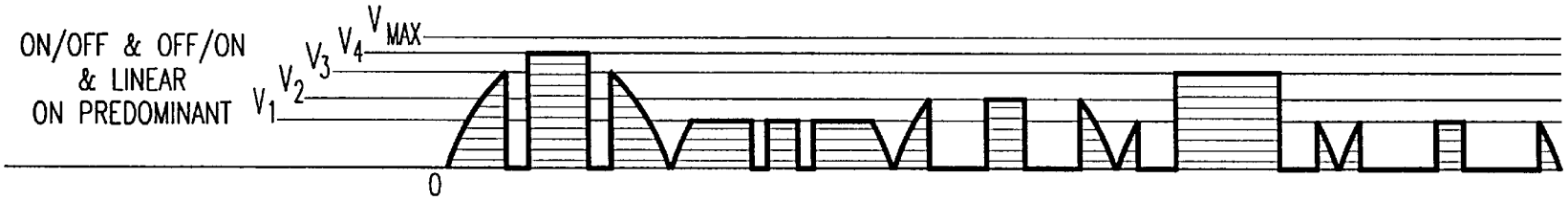
FIG. 6I is a graphical illustration of the ON/OFF/ON/LINEAR combination Benistor's voltage versus time.
Figure 6J:
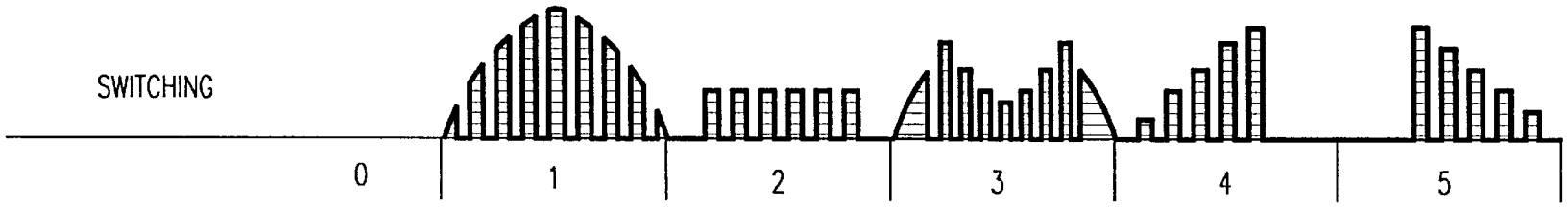
FIG. 6J is a graphical illustration of the Switching Benistor's voltage versus time.

As embodied herein, the Benistor, as a controllable electron valve, is able to control separately or simultaneously the output voltage (OFF/ON mode), the output maximum voltage (ON/OFF mode), and the output current (linear mode). Considering the OFF/ON electrode 7, the upper level input, the ON/OFF electrode 8, and the lower level input of a window comparator, nine variations of these operational modes are possible:

1. LINEAR mode (see FIG. 6A);
2. OFF/ON mode (see FIG. 6B);
3. ON/OFF mode (see FIG. 6C);
4. OFF/ON and ON/OFF operating simultaneously, with OFF being predominate (see FIG. 6D);
5. ON/OFF and OFF/ON operating simultaneously, with ON being predominate (see FIG. 6E);
6. OFF/ON and Linear (see FIG. 6F);
7. ON/OFF and Linear (see FIG. 6G);
8. OFF/ON and ON/OFF and Linear, with OFF being predominate (see FIG. 6H);
9. ON/OFF and OFF/ON and Linear, with ON being predominate (see FIG. 6I).

Using two or more window comparators connected in parallel or in series, it is possible to cut a power pulse wave into the same number of distinct parts as the number of the window comparators used. The number of distinct parts created inside of a power pulse wave can also be increased by using variable, rather than fixed reference voltages, input at the control electrodes of the Benistor 10.

Based on the four functional blocks 11, 12, 13, 14 of the schematic diagram of FIG. 2G and combining the basic eight electrodes, infinite embodiments of the Benistor exist. Sometimes, two of the four functional blocks may be overlapped, by including in the schematic diagram of a particular embodiment a part that is able to provide the function of more than one block. While an exhaustive view of the controllable electron valve of the present invention is not possible, for a better view of the controllable electron valve described above, a number of embodiments will be described below in order to illustrate, only generically, the possibilities of the Benistor 10 of the present invention.

a. The Parallel Comparation Method Embodiment

Figure 3A:
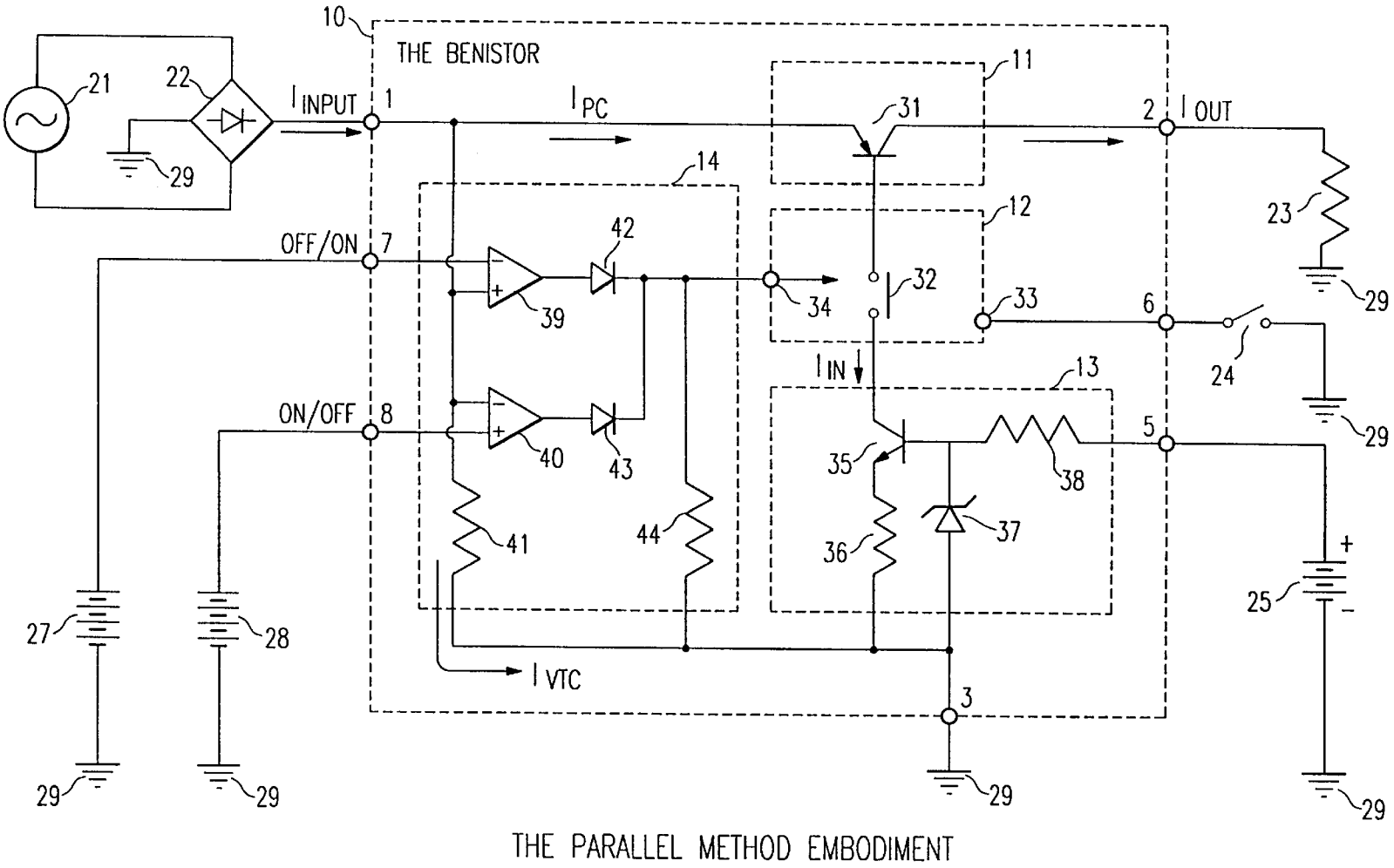
FIG. 3A illustrates the Parallel Comparation Method embodiment in accordance with the present invention.

FIG. 3A illustrates a first method embodiment of the controllable electron valve of the present invention. The Power Controller 11 comprises a PNP transistor 31. The Current Separator 12 comprises an electronic switch 32 (such as CMOS, NTE 4016B), having an initialization input 33 and commutation input 34. The Current Controller 13 comprises an NPN transistor 35, a resistor 36, a zener diode 37, and a second resistor 38. The Voltage Threshold Controller 14 comprises two comparators 39 and 40, two commutation diodes 42 and 43, and two resistors 41 and 44. All external connections are as previously described and connected in the block schematic of FIG. 2G, with the exception of the inverting current control electrode 4 and its voltage reference source 26, which does not exist in this embodiment.

The emitter of the PNP transistor 31 is coupled to the $V_{IN}$ electrode 1; the collector of the PNP transistor 31 is coupled to the $V_{OUT}$ electrode 2; and the base of the PNP transistor 31 is coupled to the collector of the NPN transistor 35 via an electronic switch 32. The initialization input 33 of the electronic switch 32 is coupled to the SS electrode 6. The emitter of the NPN transistor 35 is coupled to the common electrode 3 via a resistor 36. The base of the NPN transistor 35 is coupled to the cathode of the zener diode 37 and to the resistor 38. The other connection point of the resistor 38 is coupled to the "cc" electrode 5. The cathode of the zener diode 37 is coupled to the common electrode 3. The inverting input of the comparator 39 is coupled to the OFF/ON electrode 7. The non-inverting input of the comparator 39 is coupled to the inverting input of the comparator 37, and, together, both are coupled to the $V_{IN}$ electrode 1 and to the common electrode 3 via a resistor 41. The non-inverting input of the comparator 37 is coupled to the ON/OFF electrode 5. The output of the comparator 39 is coupled to the anode of the diode 42. The output of the comparator 40 is coupled to the anode of the diode 43. The cathode of the diode 42 and the cathode of the diode 43 are coupled together to the commutation input 34 of the electronic switch 32 and to the common electrode 3 via a resistor 44.

A current, Input, introduced through the $V_{IN}$ electrode 1, divides into two currents. The first such current, $I_{vtc}$ (voltage threshold controller), flows to the common electrode 3 via the resistor 41; the second current, $I_{pc}$ (power controller), divides into two additional currents. The larger current, $I_{OUT}$, will pass to the emitter collector junction of the PNP transistor 31 and will go to the load 23 through the $V_{OUT}$ electrode 2. The smaller current, $I_{IN}$ (internal), will pass to the common electrode 3 through the electronic switch 32, the collector emitter circuit of the NPN transistor 35 and the resistor 36. As $I_{IN}$, increases, $I_{OUT}$ will increase based on the transit relation, $I_{OUT}$=b $I_{IN}$, where b is the gain factor of the PNP transistor 31.

If the electronic switch 32 is in an "ON"position and a positive voltage, larger than the threshold of the zener diode 37, is input by the noninvertor current control electrode 5, the NPN transistor 35 and the resistor 36 will act as a constant current source for the base of the PNP transistor 31. The current $I_{IN}$ is the base current of the PNP transistor 31 and also the collector emitter current of the NPN transistor 35, although they are in the same circuit. If the NPN transistor 35 will accept enough current to saturate in the base of the PNP transistor 31, the emitter collector junction of the PNP transistor 31 will act as a diode (V saturation<0.6 volts), and the entire energy from the power source (21 and 22) is transferred to the load 23, with minimal internal dissipation inside the PNP transistor 31. The resistor 36 and the zener diode 37 will keep the maximum value of $I_{IN}$ lower than a dangerous limit for the base of the PNP transistor 31, despite a large trip of the voltage incoming at the $V_{IN}$ electrode 1.

By inputting a positive voltage at the non-inverting current control electrode 5, which is lower than the threshold of the zener diode 37, the amount of current that will pass the collector emitter circuit of the NPN transistor 35 will decrease, and also the base current of the PNP transistor will decrease. When the voltage value of the reference source inputted at the non-inverting current control electrode 5, is lower than the threshold of the base emitter junction of the NPN transistor 35, $I_{IN}$ will be zero, as will the load current, $I_{OUT}$.

If a square wave generator is the input source at the non-inverting current control electrode 5, the PNP transistor 31 will control, in a switching mode of operation, the current output to the load 23.

The initial condition "normal OPEN" or "normal CLOSED" of the electronic switch 32 is set externally, via the internal initialization input 33, and the SS input electrode 6 and the external switch 24 are coupled to ground 29. If the SS electrode 6 is coupled to ground, the initial condition of the electronic switch 32 is "ON," and, if the SS electrode 6 is not coupled to ground (i.e., is in air), the initial condition of the electronic switch 32 is "OFF". The dynamic condition of the electronic switch 32 will be determined by the "HI" or the "LOW" voltage level incoming at the commutation input 34.

The two comparators 39 and 40 are connected in a parallel configuration and, together with the diodes 42, 43 and resistors 41, 44, comprise the parallel window comparator described above with respect to FIG. 1C. The upper level voltage input is the OFF/ON electrode 7, and the lower level voltage input the ON/OFF electrode 8 and the compression input is the $V_{IN}$ electrode 1. The function of all the possible combinations between the momentary voltage value inputted at the $V_{IN}$ electrode 1 with respect to the amount of the voltage inputted at the OFF/ON electrode 7 and the ON/OFF electrode 8 with respect to the output level of the voltage on the resistor 44, will be "HI" or "LOW" in accordance to the parallel window comparators voltage against time graphs illustrated in FIG. 5B. The electronic switch 32 will receive from the resistor 44 (the internal load of the parallel window comparator) either the entire voltage or no voltage, and will switch "ON" or "OFF" based on this input. The PNP transistor 31 will act as an "OFF" switch when its base current circuit is interrupted by the electronic switch 32 and as an "ON" switch when the base current of the PNP transistor 31 is not limited and pass the electronic switch 32. If the base current of the PNP transistor 31 is limited by the circuit of the NPN transistor 35, then the PNP transistor 31 will control the load 23 current in a linear or a switching/linear combination mode. Using different combinations of reference voltages inputted at all control electrodes and inputting a power pulse wave at the $V_{IN}$ electrode 1, the output voltage against time graphs on the resistive load 23 may be any of the graphs illustrated at FIG. 6 from A to J.

b. The Series Comparison Method Embodiment

Figure 3B:
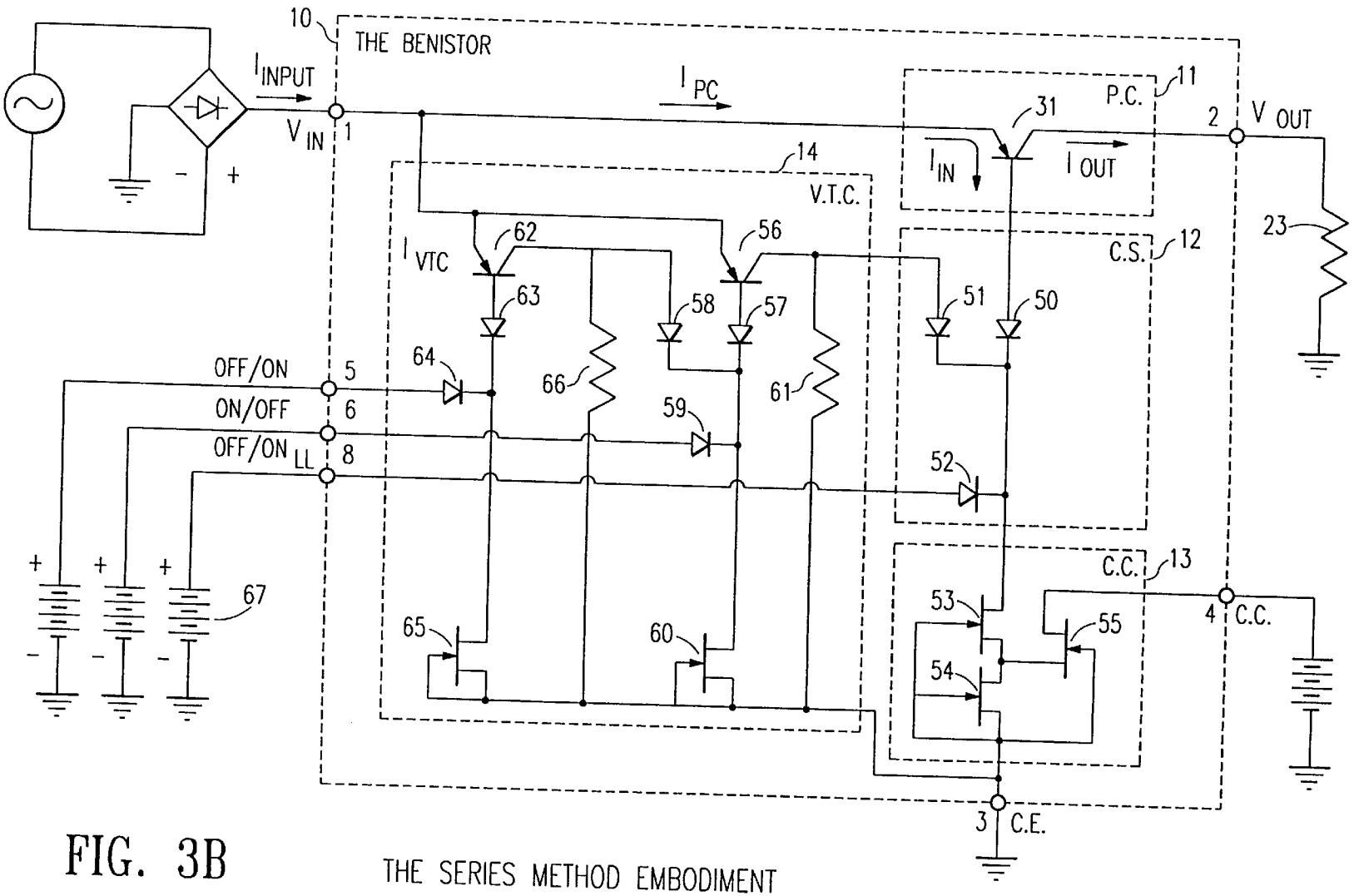
FIG. 3B illustrates the Series Comparation Method embodiment in accordance with the present invention.

FIG. 3B illustrates a second embodiment of the present invention as a controllable electron valve of the present invention, which comprises the same four blocks as previously described with respect to FIG. 2G. The Power Controller 11 comprises a PNP transistor 31, the Current Separator 12 comprises three commutation diodes 50, 51, 52. The Current Controller 13 comprises three J N Channel FET transistors 53, 54, 55. The Voltage Threshold Controller 14 comprises two PNP transistors 56, 62, five commutation diodes 57, 58, 59, 63, 65, two J N Channel FET transistors 60, 64, and two resistors 61, 66. All external connections are as shown in FIG. 2E and as described in the block schematic (FIG. 2G), with the exception of non inverting current control "cc" electrode 5, the voltage reference 25, the switch selector "SS" electrode 6, and the external switch 24.

A new OFF/ON electrode, OFF/ON lower level (or OFF/ON LL), like the other control electrodes, is externally coupled to the positive pole of a voltage reference source 67. The negative pole of the voltage reference source is coupled to ground.

The emitter of the first PNP transistor 31 is coupled to the $V_{IN}$ electrode 1; the collector of the first PNP transistor 31 is coupled to the $V_{OUT}$ electrode 2; and the base of the first PNP transistor 31 is coupled to the anode of the first commutation diode 50. The cathode of the first commutation diode 50 is coupled to the cathode of the second commutation diode 51, to the cathode of the third commutation diode 52, and to the drain of the first FET transistor 53. The source of the first FET transistor 53 is coupled to the drain of the second FET transistor 54 and to the source of the third FET transistor 55. The source of the second FET transistor 54 is coupled to the common electrode 3. The gate of the first FET transistor 53, the gate of the second FET transistor 54, and the gate of the third FET transistor 55 are coupled to the common electrode 3. The drain of the third FET transistor 55 is coupled to the inverting current control electrode 4.

The anode of the third commutation diode 52 is coupled to the OFF/ON lower level electrode 9. The anode of the second diode 51 is coupled to the collector of the second PNP transistor 56 and to the common electrode 3 via the first resistor 61. The emitter of the second PNP transistor 56 is coupled to the $V_{IN}$ electrode 1. The base of the second PNP transistor 56 is coupled to the anode of the fourth commutation diode 57. The cathode of the fourth commutation diode 57 is coupled to the cathode of the fifth commutation diode 58, to the cathode of the sixth commutation diode 59, and to the drain of the fourth FET transistor 60. The gate and the source of the fourth FET transistor 60 are coupled to the common electrode 3. The anode of the sixth commutation diode 59 is coupled to the OFF/ON electrode 7. The anode of the fifth commutation diode 58 is coupled to the collector of the third PNP transistor 62 and to the common electrode 3 via the second resistor 66. The emitter of the third PNP transistor 62 is coupled to the $V_{IN}$ electrode 1. The base of the third PNP transistor 62 is coupled to the anode of the seventh commutation diode 63. The cathode of the seventh commutation diode 63 is coupled to the cathode of the eighth commutation diode 65, and to the drain of a fifth FET transistor 64. The gate and the source of the fifth FET transistor 64 are coupled to the common electrode 3. The anode of the eighth commutation diode 65 is coupled to the OFF/ON electrode 7.

A current, Iinput, introduced through the $V_{IN}$ electrode 1, divides into two currents. The first, $I_{vtc}$ (voltage threshold controller) flows to the common electrode 3 by either of two paths: (1) via the second PNP transistor 56, the first resistor 61, the fourth commutation diode 57 and the fourth FET transistor 60, or (2) via the third PNP transistor 62, the fifth commutation diode 58, the fourth FET transistor 60, the second resistor 66, the seventh commutation diode 63, and the fifth FET transistor 64. The external voltage reference sources inputted at the voltage control electrodes OFF/ON 7, ON/OFF 8, and OFF/ON LL 9 will determine which of the two paths described above will be the one crossed by the $I_{vtc}$.

The second current, $I_{pc}$ (power controller), divides into two additional currents. The larger current, $I_{OUT}$ will pass to the emitter collector junction of the first PNP transistor 31 and will flow to the load 23 through the $V_{OUT}$ electrode 2. The smaller current, $I_{IN}$ (internal), will pass to the common electrode 3 via the emitter base junction of the first PNP transistor 31, the first commutation diode 50, and the drain source circuit of the first and the second FET transistor 53 and 54.

If no voltage is incoming through the first or the second commutation diodes 50, 51 and also no voltage is incoming via the inverting current control electrode 4 and the third FET transistor 55, then the first and the second FET transistors 53, 54 will act together as a constant current source for the base current, $I_{IN}$ of the first PNP transistor 31. If the current accepted by the constant current source 13 provided by the first and the second FET transistors 53, 54 is large enough to saturate in the base of the first PNP transistor 31, then the emitter collector junction of the first PNP transistor 31 will act as a diode (V saturation<0.6 V), and the entire energy from the power source 21, 22 is transferred to the load 23 with minimal internal dissipation for the first PNP transistor 31. The current $I_{IN}$ will be limited to the maximum amount accepted by the emitter base junction of the first PNP transistor 31, despite a large voltage trip of the power wave inputted at the $V_{IN}$ electrode 1.

By inputting a positive voltage at the inverting current control electrode 4, which is larger than the voltage amount at the source of the first FET transistor 53, the amount of current passing the drain source circuit of the first FET transistor 53 will decrease, and $V_{IN}$ will decrease. When the amount of the voltage inputted at the inverting current control electrode 4 is larger than the Vgs off parameter of the first FET transistor 53, $I_{IN}$ will be zero, and so will $I_{OUT}$ (where $I_{OUT}=I_{LOAD}$)—that is, $I_{LOAD}=b\ I_{IN}$. Therefore, by inputting a linearly increasing voltage at the inverting current control electrode 4, the load current will decrease linearly to zero. Moreover, the threshold of the Vgs off parameter of the first FET transistor 53 will remain at zero, despite a large increase of the voltage at the inverting current control electrode 4. If the voltage inputted at the inverting current control input 4 is incoming from a sine or square wave generator, rather than from a DC voltage reference source, and the amplitude of the incoming wave is larger than the Vgs off parameter of the first FET transistor 53, then the load current will be controlled in a switching mode of operation. As the current control electrode 4 input wave increases with respect to the Vgs off parameter of the first FET transistor 53, the slew rate of the load's voltage (E=IR) will become faster.

As embodied and broadly explained herein, a circuit comprising a PNP transistor 31, a commutation diode 50, and three FET transistors 53, 54, 55 acts as an INVERTING LINEAR BENISTOR. This Benistor is able to control the current incoming from a power source at the "$V_{IN}$" electrode 1 and outputting through the "$V_{OUT}$" electrode 2 to a load, in a linear and/or switching mode of operation. Such control is accomplished by inputting, with respect to the common "CE" electrode 3, a fixed or variable voltage reference source at the inverting current control electrode 4.

By inputting a positive DC voltage via the OFF/ON LL electrode 9 that is large enough to pass the third commutation diode 52, a positive voltage threshold will be created at the drain off the first FET transistor 53. As the power wave pulse is increasing at the $V_{IN}$ electrode, the first commutation diode 50 and the emitter base junction of the first PNP transistor 31 will be blockaded during the period when the momentary value of the input power wave is lower than the amount of the voltage threshold created at the drain of the first FET transistor 53, and will be in conduction during the time when the momentary value of the power wave pulse is larger than that positive threshold. Therefore, the first PNP transistor will act as an "OFF" switch (no base current) for the first pulse period of time, and as an "ON" switch for the second pulse period of time (all base current). In other words, if the current is not limited by the first and the second FET transistors 53, 54, the circuit is acting in the self-switching mode of operation as an OFF/ON Benistor. The first PNP transistor 31 acts as a "Power Controller," the two commutation diodes 50 and 52 act simultaneously as a "Current Separator" and "Voltage threshold Controller," and the first and second FET transistors 53, 54 act together as a "Current Controller."

As embodied and broadly explained herein, a circuit comprising a PNP transistor 31, two commutation diodes 50, 52, and three FET transistors 53, 54, 55 acts as an INVERTING OFF/ON Benistor. This Benistor is able to control in linear, switching, and/or OFF/ON self-switching modes of operation the amount of current and/or the effective voltage value of a pulse power wave incoming at the "$V_{IN}$" electrode 1 and outputting to a load trough the "$V_{OUT}$" electrode 2. Such control is accomplished by inputting, with respect to the common "CE" electrode 3, fixed or variable voltage reference sources at the "cc" electrode 4 and/or at the OFF/ON LL electrode 9.

The circuit including the second PNP transistor 56, the commutations diodes 57 and 59, and the FET transistor 60 comprises a second Benistor, which does not have any current control electrode. Therefore, this is only an OFF/ON Benistor, having the same "$V_{IN}$" electrode 1 and the same common "CE" electrode 3 as does the first Benistor described above, in which the "ON/OFF" electrode 8 acts as a self-switching voltage control electrode and the first resistor 61 acts as an internal load. The output of the second Benistor represents an internal $V_{OUT}$ coupled to another internal OFF/ON input of the first Benistor, via the commutation diode 51. Similar to the first circuit, by inputting a DC voltage reference via the ON/OFF electrode 8 and the sixth commutation diode 59, a positive voltage threshold is created at the drain of the fourth FET transistor 60. Therefore, the second PNP transistor 56 will act as an "OFF" switch during the first period of the increasing power wave input at the "$V_{IN}$" electrode 1, and as an "ON" switch during the second period. During the time when the second PNP transistor 56 acts as a switch in the "ON" condition, the voltage on the first resistor will be "HI", the second commutation diode 51 will be in conduction, the first commutation diode 50 will be blockaded, and the first PNP transistor 31 will be in the "OFF" condition. Similarly, during the time when the second PNP transistor 56 acts as an "OFF" switch, the second commutation diode 51 will be blockaded, the first commutation diode 50 will be in conduction, and the first PNP transistor will be in the "ON" condition. Therefore, with respect to the external load 23, the first Benistor inverts the function of the second Benistor, and the OFF/ON voltage control input of the second Benistor becomes an ON/OFF electrode 8 for the entire circuit, comprising two Benistors coupled in this way.

As embodied and broadly described herein, in a circuit including two OFF/ON Benistors coupled in series (cascade), where the output of one is connected to the OFF/ON voltage input of the other one, respectively, the "$V_{IN}$" electrodes are coupled together, and the "CE" electrodes are coupled together, the circuit comprises an "ON/OFF" Benistor.

A circuit that includes the third PNP transistor 62, the seventh commutation diode 63, the sixth FET transistor 64, and the eighth commutation diode 65 comprises a third OFF/ON Benistor, having the same "$V_{IN}$" and "CE" electrodes as the first two Benistors described above. This third Benistor has as its self-switching voltage control input the OFF/ON electrode 7 and has as an internal load the second resistor 66. Via the fifth commutation diode 58, the third Benistor is controlled identically to the second Benistor.

At the same time, this OFF/ON Benistor is acting simultaneously as a comparator. And, based on the comparison made between the momentary voltage value inputted at the "$V_{IN}$" electrode and the reference voltage inputted at the OFF/ON electrode, the output on the second resistor 66, as an internal load for the third Benistor, will be "LOW" before the momentary value of the power poles wave will reach the voltage threshold inputted at the OFF/ON electrode 7, and will be "HI" after that. Similarly, the second Benistor is a comparator between "$V_{IN}$" momentary voltage and the "ON/OFF" electrode 8 voltage threshold. Whenever a transistor acts as an inverting amplifier with respect to the base voltage versus the collector voltage, for each Benistor acting as a comparator, the inverting input will be the voltage control input electrode, and the non-inverting input the "$V_{IN}$" electrode 1. Therefore, the structure of a two-Benistor circuit coupled in series (cascade) is functionally identical to the prior art. "Series window comparator" schematic diagram described above and illustrate in FIG. 1D. Together with the first Benistor, the entire circuit comprises a "triple ended comparator or a double window comparator," having as reference inputs the OFF/ON electrode 7, the ON/OFF electrode 8, and the OFF/ON LL electrode 9, and as a compression input the "$V_{IN}$" electrode 1. The OFF/ON LL (low level) electrode 9 creates a means to eliminate the switch selector "SS" electrode 6—whenever the "ON predominant" or "OFF predominant" is made based on the choice for one of the two OFF/ON electrodes, which in turn will create the "window" with the single ON/OFF electrode. Of course, using simultaneously all three voltage control electrodes and inputting a lower voltage level at the OFF/ON LL electrode 9, a medium level voltage at the ON/OFF electrode 8, and an upper voltage level at the OFF/ON electrode 7 will provide one more self commutation during a power poles period.

As embodied and broadly described herein, a circuit comprising two or more Benistors coupled in series (cascaded) acts as a series poly-window comparator, having as many windows as Benistors that are connected.

As embodied and broadly described herein, a circuit comprising two or more Benistors coupled in series may act as a "Voltage Threshold Controller" block of a larger Benistor circuit.

C. Embodiment for a Three-Terminal OFF/ON Benistor

Figure 4A:
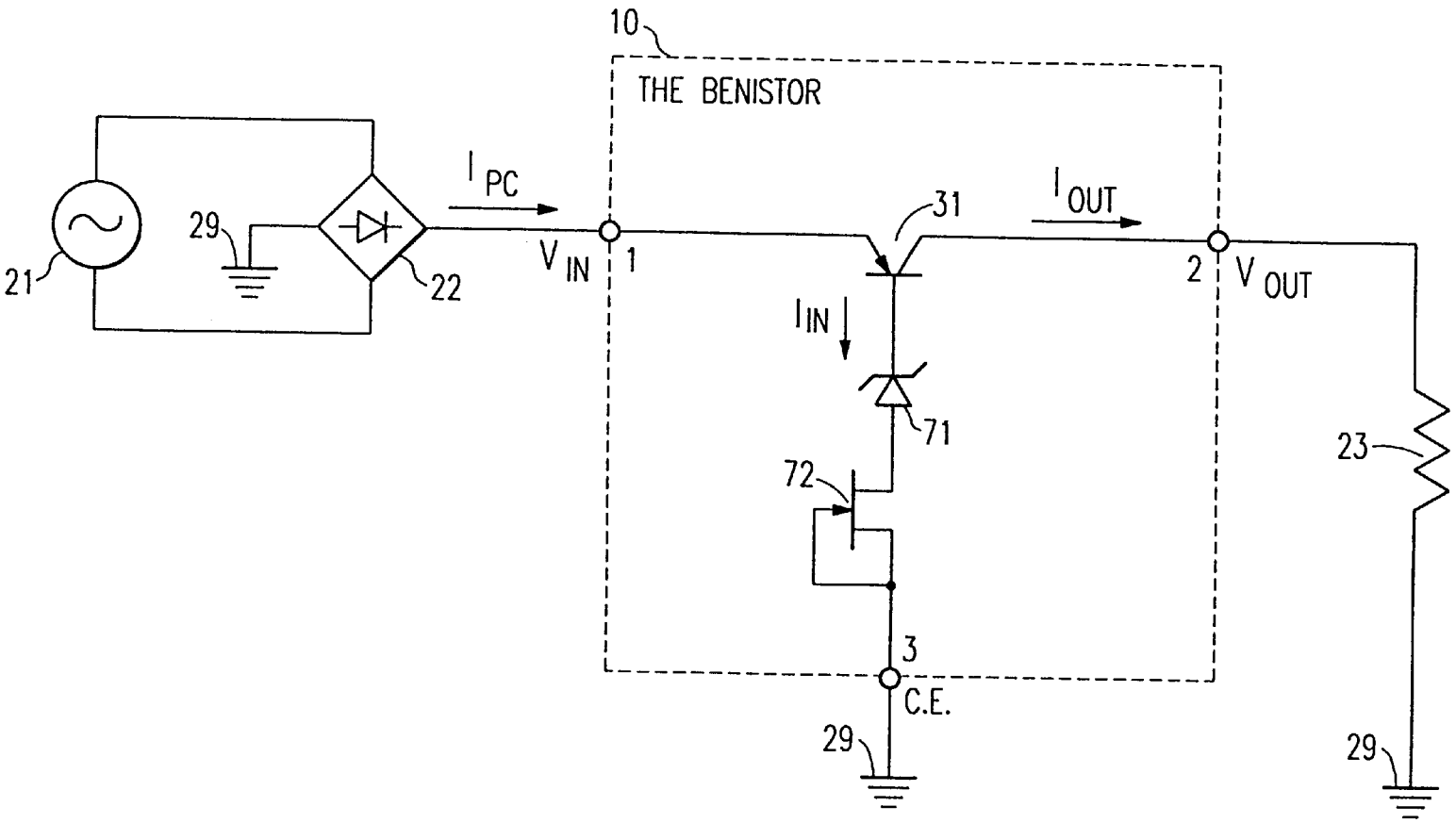
FIG. 4A illustrates the Three-Terminal OFF/ON Benistor embodiment of the present invention.

FIG. 4A illustrates a minimal parts embodiment of an OFF/ON Benistor 10. The basic three electrodes, $V_{IN}$1, $V_{OUT}$2, and CE 3, are externally connected in an identical manner as described above. The Power Controller 11 comprises a PNP transistor 31. The Current Separator 12 and the Voltage Threshold Controller 14 are overlapping and comprise only one part, a zener diode 71. The Current Controller 13 comprises an N-channel FET transistor 72.

The collector of the PNP transistor 31 is coupled to the "$V_{IN}$" electrode 1. The emitter of the PNP transistor 31 is coupled to the "$V_{OUT}$" electrode 2. The base of the PNP transistor 31 is coupled to the cathode of a zener diode 71. The anode of the zener diode 71 is coupled to the drain of the FET transistor 72. The gate and the source of the FET transistor 72 are coupled to the common "CE" electrode 3.

A current, $I_{pc}$, inputted from a pulse power wave source trough the $V_{IN}$ electrode 1 is divided in two currents, $I_{IN}$ and $I_{OUT}$. $I_{OUT}$ is the larger of the two currents, and the relation to $I_{IN}$ is: $I_{OUT}$=b $I_{IN}$. $I_{IN}$ is the emitter base current of the PNP transistor 31 and flows to ground via the zener diode 71 and the drain source circuit of the FET transistor 72, which together act as a constant current source and limit the current $I_{IN}$ to the saturation value of the PNP transistor 31. $I_{IN}$ will be zero until the momentary voltage value of the power pulse inputted at the $V_{IN}$ electrode 1 is lower than the threshold of the zener diode 71, and $I_{IN}$ will rapidly switch to the saturation value for the base of the PNP transistor 31. Therefore, the PNP transistor 31 will act as an "OFF" switch during the period when the momentary voltage value inputted at the $V_{IN}$ electrode 1 is lower than the threshold of the zener diode 71 and will act as an "ON" switch during the period when the momentary voltage value inputted at the $V_{IN}$ electrode 1 is higher than the threshold of the zener diode 71. FIG. 6B illustrates the voltage versus time graphs for an OFF/ON Benistor using different voltage threshold zener diodes.

d. Embodiment for a Three-Terminal ON/OFF Benistor

Figure 4B:
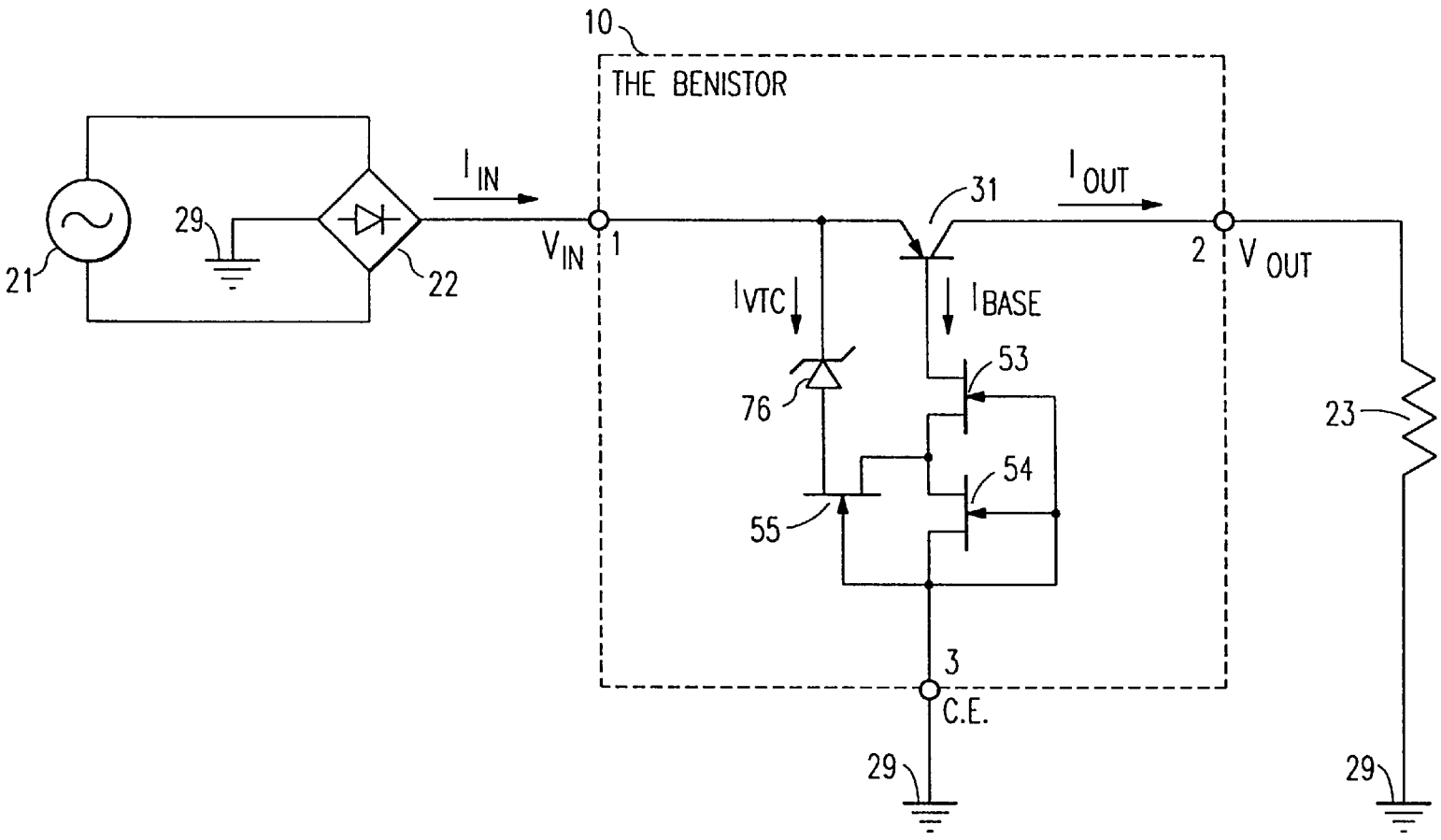
FIG. 4B illustrates the Three-Terminal ON/OFF Benistor embodiment of the present invention.

FIG. 4B illustrates a minimal parts embodiment for an ON/OFF Benistor 10. The basic three electrodes, $V_{IN}$1, $V_{OUT}$2, and CE 3, are externally connected in an identical manner to described above. The Power Controller 11 comprises a PNP transistor 31. The Current Separator 12 comprises an N-channel FET transistor 55. The Current Controller 13 comprises two N-channel FET transistors 53, 54. The Voltage Threshold Controller 14 comprises a zener diode 75.

The collector of the PNP transistor 31 is coupled to the $V_{IN}$ electrode 1. The emitter of the PNP transistor 31 is coupled to the $V_{OUT}$ electrode 2. The base of the PNP transistor 31 is coupled to the drain of a first FET transistor 53. The source of the first FET transistor is coupled to the drain of a second FET transistor 54 and to the source of a third N channel FET transistor 55. The drain of the third FET transistor is coupled to the anode of the zener diode 76. The cathode of the zener diode 76 is coupled to the $V_{IN}$ electrode. The source of the second FET transistor 54, the gate of the first FET transistor 53, the gate of the second FET transistor 54, and the gate of the third FET transistor 55 are coupled to the common "CE" electrode 3.

A current, $I_{IN}$, inputted from a pulse power source trough the $V_{IN}$ electrode 1 is divided into two currents: $I_{vtc}$ and $I_{pc}$. $I_{vtc}$ flows via the zener diode 76 and via the second and third FET transistors drain source circuit 55, 54 to the common "CE" electrode 3. $I_{pc}$ flows into the PNP transistor 31 and is divided into two currents: $I_{OUT}$ and $I_{BASE}$. $I_{OUT}$ is the larger current of the two, and the relation between $I_{OUT}$ and $I_{BASE}$ is $I_{OUT}$=b $I_{BASE}$.

$I_{BASE}$ is the emitter base current of the PNP transistor 31 and flows to the common "CE" electrode 3, via the drain source circuit of the two FET transistors 53 and 54. The circuit comprising the FET transistors 53, 54, and 55 acts as a constant current source for $I_{BASE}$ and a current separator for the zener diode 76 in the manner described above.

During the time when the momentary voltage value of the pulse power wave inputted at the "$V_{IN}$" electrode 1 is lower than the threshold of the zener diode 75 $I_{BASE}$ is the saturation current for the PNP transistor 31, which will act as an "ON" switch. When the voltage value of the pulse power wave inputted at the "$V_{IN}$" electrode 1 is larger than the threshold of the zener diode 76, the current $I_{vtc}$ which passes the zener diode 76, will increase the voltage at the source of the first FET transistor 53, via the third FET transistor 55. As soon the voltage value at the source of the first FET transistor 53 is larger than the Vgs off parameter of the FET transistor 53, $I_{BASE}$ will be zero and the PNP transistor 31 will act as an "OFF"switch. FIG. 6C illustrates the voltage versus time graphs of an "ON/OFF" Benistor using different voltage thresholds zener diodes.

e. Embodiment for a Three-Terminal Linear Benistor

Figure 4C:
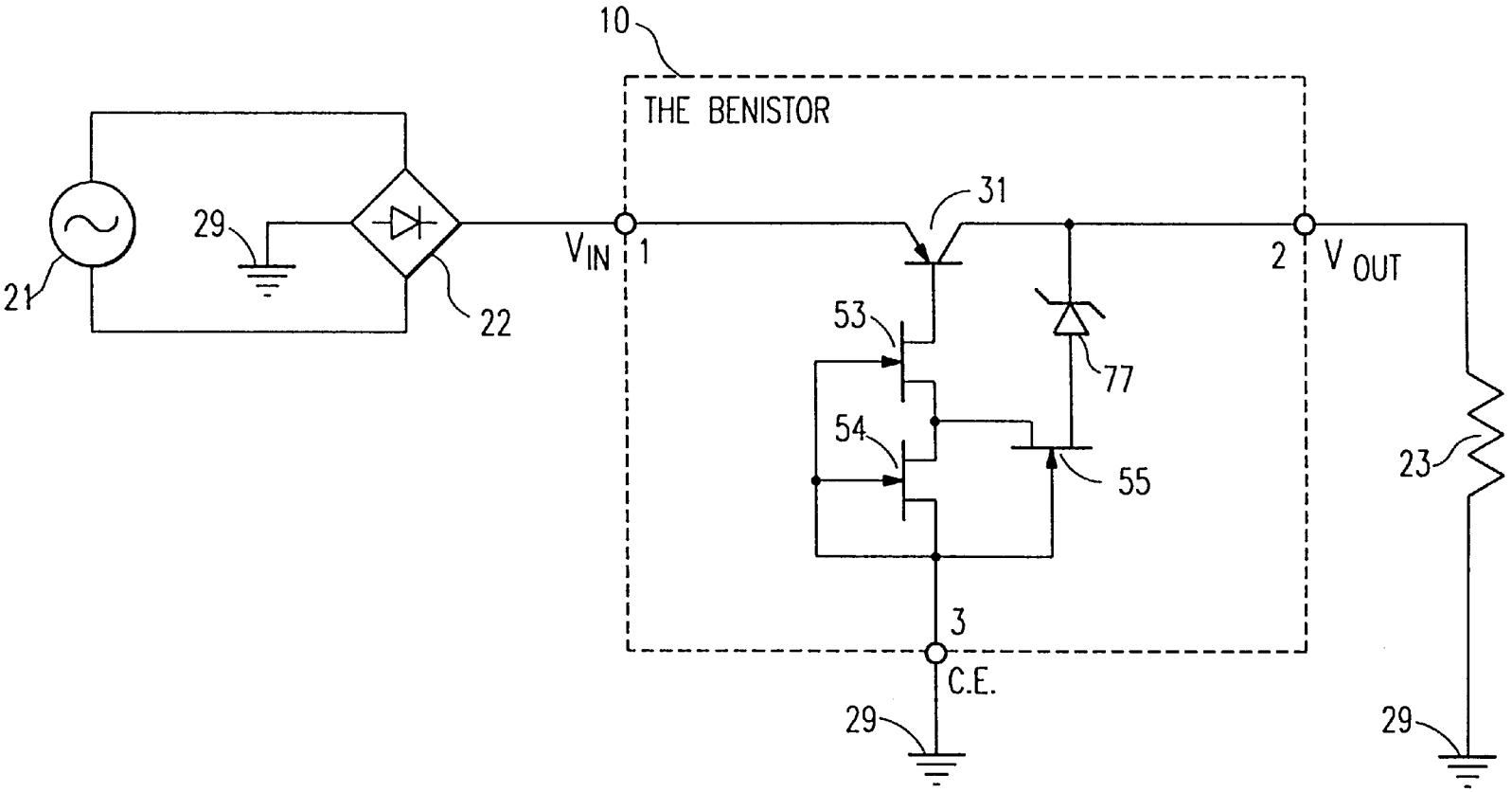
FIG. 4C illustrates the Three-Terminal Linear Benistor embodiment of the present invention.

FIG. 4C illustrates a minimal parts embodiment for a LINEAR Benistor 10. The basic three electrodes, $V_{IN}$1, $V_{OUT}$2, and CE 3, are externally connected in an identical manner as described above. The Power Controller 11 comprises a PNP transistor 31. The Current Separator 12 comprises an N-channel FET transistor 55. The Current Controller 13 comprises two N-channel FET transistors 53 and 54. The Voltage Threshold Controller 14 comprises a zener diode 77, which is included in a negative feedback arrangement with the Current Controller 13.

The emitter of the PNP transistor 31 is coupled to the $V_{IN}$ electrode 1. The collector of the PNP transistor 31 is coupled to the $V_{OUT}$ electrode 2. The base of the PNP transistor 31 is coupled to the drain of a first FET transistor 53. The source of the first FET transistor 53 is coupled to the drain of a second FET transistor 54 and to the source of the third FET transistor 55. The drain of the third FET transistor 55 is coupled to the anode of a zener diode 77. The cathode of the zener diode 77 is coupled to the $V_{OUT}$ electrode 2. The source of the second FET transistor 54, the gate of the first FET transistor 53, the gate of the second FET transistor 54, and the gate of the third FET transistor 55 are coupled to the common CE electrode 3. The PNP transistor 31 and the three FET transistors 53, 54, 55 form a circuit functionally similarly to the last embodiment, having respectively the same reference numbers. The only difference is that the zener diode 77, which in the present embodiment is connected in a feedback arrangement to the $V_{OUT}$ electrode 2. This is done in order to limit the output voltage by decreasing the input current.

By inputting a pulse power wave at the $V_{IN}$ electrode 1, the output voltage at the $V_{OUT}$ electrode 2 will follow the input voltage up to the threshold of the zener diode 77. The output voltage will be limited in linear mode to the voltage value of the zener threshold plus the voltage value of the Vgs off parameter of the first FET transistor 53. FIG. 6A illustrates the voltage versus time graphs at the output of a LINEAR Benistor, using different voltage threshold zener diodes.

It will be apparent to those skilled in the art that various modifications and variations can be made in the apparatus and method of the present invention without departing from the spirit or scope of the invention. Thus, it is intended that the present invention cover the modifications and variations of this invention, provided they come within the scope of the appended claims and their equivalents.

I claim:

1. An electron valve having an input, an output, and a controller coupled to the input and the output, the controller capable of controlling the output so as to be operable in a linear mode, an external switching mode, and a self-switching mode, and in any combination of the linear mode, the external switching mode, and the self-switching mode.

2. The electron valve of claim 1 wherein the output being controlled is an output current.

3. The electron valve of claim 1 wherein the external switching mode is responsive to the input.

4. A monolithic integrated circuit having an input, an output, and a controller coupled to the input and the output, the controller capable of controlling the output so as to be operable in a linear mode, an external switching mode, and a self-switching mode, and in any combination of the linear mode, the external switching mode, and the self-switching mode.

5. The monolithic integrated circuit of claim 4 wherein the output being controlled is an output current.

6. The monolithic integrated circuit of claim 4 wherein the external switching mode is responsive to the input.

7. An electron valve configured to operate in a linear mode, an external switching mode switching mode, and in any combination of the linear mode, the external switching mode, and the self-switching mode.

8. A monolithic integrated circuit configured to operate in a linear mode, an external switching mode, and a self-switching mode, and in any combination of the linear mode, the external switching mode, and the self-switching mode.

9. A method for controlling an output current of an electron valve, comprising providing an input to the electron valve; providing an external control signal to the electron valve; and controlling the output current in response, at least in part, to the input and the external control signal, thereby enabling operation of the electron valve in a linear mode, an external switching mode, and a self-switching mode, and in any combination of the linear mode, the external switching mode, and the self-switching mode.

10. A method for controlling operation of an electron valve having an output current, comprising coupling the electron valve to an external input source; providing an internal electron valve feedback signal that is a function at least in part of the output current; and operating the electron valve, a linear mode, an external switching mode responsive of the external input source, and a self-switching mode responsive to the feedback signal, and in any combination of the linear mode, the external switching mode, and the self-switching mode.

11. A controllable electron valve having an output current and an output voltage, the electron valve having a controller that controls the output current and the output voltage separately or simultaneously such that the output can be operated in a linear mode, an external switching mode, and a self-switching mode responsive to the feedback signal, and in any combination of the linear mode, the external switching mode, and the self-switching mode.

12. The controllable electron valve of claim 11, the controller including a comparator for controlling, at least in part, the output voltage, and a current controller for controlling the output current.

13. The controllable electron valve of claim 12, further including a power controller, coupled to the current controller, the power controller having an internal resistance, such that the output current is controlled by the current controller by varying the internal resistance of the power controller.

14. The controllable electron valve of claim 12 wherein the controllable electron valve has an input current, and the input current and the output current are substantially equal when the electron valve is separately controlling the output voltage.

15. A controllable electron valve having an output current and an output voltage, the electron valve comprising a comparator for controlling, at least in part, the output voltage and a current controller for controlling the output current to permit either separate or simultaneous control of the output current and the output voltage, such that the output is operable in a linear mode, an external switching mode, and a self-switching mode responsive to the feedback signal, and in any combination of the linear mode the external switching mode, and the self-switching mode.

* * * * *